US010289016B2

(12) United States Patent
Fukudome et al.

(10) Patent No.: US 10,289,016 B2
(45) Date of Patent: May 14, 2019

(54) TONER

(71) Applicant: CANON KABUSHIKI KAISHA, Tokyo (JP)

(72) Inventors: Kosuke Fukudome, Tokyo (JP); Hiroyuki Tomono, Numazu (JP); Shuhei Moribe, Mishima (JP); Koji Nishikawa, Susono (JP); Daisuke Yoshiba, Suntou-gun (JP); Shotaro Nomura, Suntou-gun (JP); Atsuhiko Ohmori, Yokohama (JP); Sho Kimura, Kashiwa (JP); Tatsuya Saeki, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/840,404

(22) Filed: Dec. 13, 2017

(65) Prior Publication Data

US 2018/0173125 A1 Jun. 21, 2018

(30) Foreign Application Priority Data

Dec. 21, 2016 (JP) ..... 2016-247445
Nov. 7, 2017 (JP) ..... 2017-214464

(51) Int. Cl.
*G03G 9/087* (2006.01)
*G03G 9/09* (2006.01)
*G03G 9/08* (2006.01)

(52) U.S. Cl.
CPC ..... *G03G 9/08755* (2013.01); *G03G 9/0819* (2013.01); *G03G 9/08793* (2013.01); *G03G 9/08795* (2013.01); *G03G 9/08797* (2013.01); *G03G 9/0902* (2013.01)

(58) Field of Classification Search
CPC ..... G03G 9/087; G03G 9/08755
See application file for complete search history.

(56) References Cited

U.S. PATENT DOCUMENTS 6,875,549 B2 4/2005 Yamazaki et al.
6,881,527 B2 4/2005 Moribe et al.
7,267,919 B2 9/2007 Moribe et al.
7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,537,877 B2 5/2009 Yoshiba et al.
7,544,455 B2 6/2009 Yoshiba et al.
7,582,401 B2 9/2009 Ogawa et al.
7,638,251 B2 12/2009 Yamazaki et al.
7,700,254 B2 4/2010 Moribe et al.
7,740,998 B2 6/2010 Yamazaki et al.
7,745,089 B2 6/2010 Okubo et al.
7,796,926 B2 9/2010 Matsuda et al.
7,855,042 B2 12/2010 Kobori et al.
7,897,316 B2 3/2011 Yamazaki et al.
8,026,030 B2 9/2011 Moribe et al.
8,057,977 B2 11/2011 Moribe et al.
8,227,162 B2 7/2012 Sano et al.
8,426,094 B2 4/2013 Magome et al.
8,501,377 B2 8/2013 Takahashi et al.
8,512,925 B2 8/2013 Moribe et al.
8,614,044 B2 12/2013 Matsui et al.
8,778,585 B2 7/2014 Matsui et al.
8,883,389 B2 11/2014 Matsui et al.
9,034,549 B2 5/2015 Shiotari et al.
9,040,216 B2 5/2015 Fukudome et al.
9,097,997 B2 8/2015 Nomura et al.
9,097,998 B2 8/2015 Yamazaki et al.
9,116,448 B2 8/2015 Terauchi et al.
9,128,400 B2 9/2015 Takahashi et al.
9,134,637 B2 9/2015 Hotta et al.
9,141,012 B2 9/2015 Moribe et al.
9,152,065 B2 10/2015 Sano et al.
9,201,323 B2 12/2015 Nishikawa et al.
9,213,250 B2 12/2015 Nomura et al.
9,213,251 B2 12/2015 Ohmori et al.
9,217,943 B2 12/2015 Matsui et al.
9,239,528 B2 1/2016 Hasegawa et al.
9,250,548 B2 2/2016 Nomura et al.
9,261,804 B2 2/2016 Yamazaki et al.
9,261,806 B2 2/2016 Moribe et al.
9,285,697 B2 3/2016 Fukudome et al.
9,304,422 B2 4/2016 Matsui et al.
9,341,970 B2 5/2016 Yoshiba et al.
9,348,246 B2 5/2016 Magome et al.
9,354,545 B2 5/2016 Matsui et al.
(Continued)

FOREIGN PATENT DOCUMENTS

JP 2007-086459 4/2007
JP 2015-052697 3/2015

OTHER PUBLICATIONS

U.S. Appl. No. 15/843,137, filed Dec. 15, 2017, Atsuhiko Ohmori.

*Primary Examiner* — Mark A Chapman
(74) *Attorney, Agent, or Firm* — Venable LLP

(57) ABSTRACT

Provided is a toner having a toner particle including a binder resin and a colorant, wherein the toner has a softening point of at least 100° C. and not more than 150° C., and when Tgt represents a glass transition temperature (° C.) of the toner during a second temperature rise as measured with a DSC, Tgf represents a glass transition temperature (° C.) of a tetrahydrofuran-insoluble matter of the binder resin during a second temperature rise as measured with a DSC, and Tgk represents a glass transition temperature (° C.) of a tetrahydrofuran-soluble matter of the binder resin during a second temperature rise as measured with a DSC, the toner satisfies Tgt>Tgf (1), Tgt>Tgk (2), and 35° C.≤Tgf≤70° C. (3).

8 Claims, No Drawings

(56) References Cited

U.S. PATENT DOCUMENTS

| | | | |
|---|---|---|---|
| 9,442,416 | B2 | 9/2016 | Magome et al. |
| 9,470,993 | B2 | 10/2016 | Nishikawa et al. |
| 9,557,669 | B2 | 1/2017 | Nagai et al. |
| 9,575,425 | B2 | 2/2017 | Naka et al. |
| 9,588,450 | B2 | 3/2017 | Tsuda et al. |
| 9,594,323 | B2 | 3/2017 | Fujikawa et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,829,818 | B2 | 11/2017 | Yoshiba et al. |
| 2004/0110076 | A1 | 6/2004 | Yamazaki et al. |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2015/0125790 | A1 | 5/2015 | Hotta et al. |
| 2015/0185658 | A1 | 7/2015 | Wakabayashi et al. |
| 2015/0220013 | A1 | 8/2015 | Nishikawa et al. |
| 2016/0139522 | A1 | 5/2016 | Yoshiba et al. |
| 2016/0161874 | A1 | 6/2016 | Yamazaki et al. |
| 2016/0202624 | A1 | 7/2016 | Nishikawa et al. |
| 2017/0160661 | A1 | 6/2017 | Suzumura et al. |
| 2017/0199475 | A1 | 7/2017 | Fukudome et al. |
| 2018/0004109 | A1 | 1/2018 | Matsui et al. |

TONER

BACKGROUND OF THE INVENTION

Field of the Invention

The present invention relates to a toner for use in electrophotographic methods, electrostatic recording methods, magnetic recording methods and the like.

Description of the Related Art

Increased print speeds, energy efficiency and space saving are conventional demands made of laser beam printers (LBP).

Because the time spent passing through the fixing unit is shorter at faster print speeds, the amount of heat received by the toner is less even if the temperature setting of the fixing unit is the same. Lower temperature settings are also desirable from the standpoint of energy savings, and thus there is a demand for toners with good low-temperature fixability.

To improve low-temperature fixability, the toner is preferably sharp-melted within the fixing nip, and design features such as softer binder resins are desirable for this purpose.

However, it is known that when measures are taken to improve the low-temperature fixability of the toner, discharge adhesion of the printed image becomes a problem.

Discharge adhesion here means that when consecutively printed images accumulate in the printer output tray, the images stick together because they are stacked while still hot, and image defects then occur when the adhering images are pulled apart.

Discharge adhesion is especially likely during double-sided continuous printing because there is more heat accumulation on the fixed paper, and the sheets are stacked while still hot. Double-sided printing has become more common recently as a way of effectively using paper resources in the office, and further improvements are needed.

Fixed papers are also more likely than in the past to accumulate without time to cool due to recent increases in printer speed, so discharge adhesion is highly likely under current conditions.

One possible method of solving the problem of discharge adhesion is to promote cooling of the fixed paper by installing several cooling fans in the main printer unit. However, such methods may pose problems in terms of energy savings and printer size.

Thus, despite demand for toners with both low-temperature fixability and low discharge adhesion, there remains room for improvement.

Japanese Patent Application Publication No. 2007-86459 describes a toner in which both low-temperature fixability and hot offset resistance are achieved by functional separation, by including a linear component soluble in organic solvents (soluble component) and a crosslinked component insoluble in organic solvents (insoluble component) in the toner.

Japanese Patent Application Publication No. 2015-52697 describes a toner in which both low-temperature fixability and heat-resistant storability are achieved by designing both the toner itself and a tetrahydrofuran-insoluble matter in the toner with low glass transition temperatures, and by forming a shell of a resin fine particle with a high glass transition temperature on the toner surface.

SUMMARY OF THE INVENTION

The researches of the inventors and others have shown that because the linear component of the toner described in Japanese Patent Application Publication No. 2007-86459 has a relatively low glass transition temperature (Tg) and a low viscosity, it has good low-temperature fixability but is more liable to discharge adhesion. Moreover, the crosslinked component tends to detract from the low-temperature fixability because it has a high glass transition temperature, high viscosity and high elasticity.

Moreover, toners with good low-temperature fixability may also have problems of storage stability in severe environments (severe storability) and curling of the ends of the fixed image (curl resistance), so improvement is needed.

The technology described in Japanese Patent Application Publication No. 2015-52697 does indeed provide some improvement in the low-temperature fixability and heat-resistant storability of the toner.

However, the shell effect of the resin fine particles is reduced in the image after fixation because the toner has melted, and discharge adhesion may be a problem during double-sided continuous printing. Thus, there is room for improvement for purposes of use in printers that are prone to discharge adhesion.

Thus, there is demand for toners with good low-temperature fixability of the toner, discharge adhesion properties, severe storability and curl resistance, and further improvements are needed.

That is, the present invention provides a toner that has good discharge adhesion properties in addition to providing good low-temperature fixability, severe storability and curl resistance.

The present invention is a toner having a toner particle including a binder resin and a colorant, wherein the toner has a softening point of at least 100° C. and not more than 150° C., and the toner satisfies the following formulae (1) to (3), $$Tgt > Tgf \quad (1)$$

$$Tgt > Tgk \quad (2)$$

$$35^\circ\ C. \leq Tgf \leq 70^\circ\ C. \quad (3)$$

wherein,

Tgt represents a glass transition temperature (° C.) of the toner during a second temperature rise as measured with a differential scanning calorimeter (DSC), Tgf represents a glass transition temperature (° C.) of a tetrahydrofuran-insoluble matter of the binder resin during a second temperature rise as measured with a differential scanning calorimeter (DSC), and Tgk represents a glass transition temperature (° C.) of a tetrahydrofuran-soluble matter of the binder resin during a second temperature rise as measured with a differential scanning calorimeter (DSC), and wherein the tetrahydrofuran-insoluble matter of the binder resin is the tetrahydrofuran-insoluble matter of the binder resin after the toner has been extracted for 18 hours by Soxhlet extraction using tetrahydrofuran, and the tetrahydrofuran-soluble matter of the binder resin is the tetrahydrofuran-soluble matter of the binder resin after the toner has been extracted for 18 hours by Soxhlet extraction using tetrahydrofuran.

Further features of the present invention will become apparent from the following description of exemplary embodiments.

DESCRIPTION OF THE EMBODIMENTS

Unless otherwise specified, numerical ranges such as "at least A and not more than B" or "A to B" in the present invention include the minimum and maximum values at either end of the range.

The inventors conducted exhaustive investigations to find a toner that would provide good low-temperature fixability in high-speed printers, as well as good discharge adhesion properties during double-sided continuous printing even in main units configured with few cooling fans in order to save space.

In a conventional design, a linear component (tetrahydrofuran-soluble matter) with a glass transition temperature (Tg) lower than the Tg of a toner is included to improve the low-temperature fixability, while a crosslinked component (tetrahydrofuran-insoluble matter) with a Tg higher than the Tg of the toner is included to improve severe storability, fixation winding and the like.

However, it has been found that even if low-temperature fixability is improved by simply including these components, it is still difficult to improve the discharge adhesion properties during double-sided continuous printing.

As a result of further research into why discharge adhesion is a problem in this kind of toner, it was discovered that discharge adhesion increases because the soft linear component separates and is exuded onto the surface of the image.

It is thought that because the linear component and crosslinked component are poorly mixed in the toner, they may undergo microscopic phase separation when the paper is discharged and stacked after fixing, promoting exudation of the linear component onto the image surface.

We therefore thought that low-temperature fixability and discharge adhesion could both be improved by further increasing the miscibility of the linear component and the crosslinked component. However, increasing miscibility by such means as stronger melt kneading was not sufficient by itself to improve the discharge adhesion.

We then discovered as a result of exhaustive research that both low-temperature fixability and discharge adhesion could be improved by dispersing the linear component and crosslinked component at a molecular level while at the same time physically entangling the two to form an integrated network structure.

We perfected the present invention after discovering that when such a network structure is formed, the Tg of the toner, the Tg of the tetrahydrofuran-soluble matter (linear component) of the binder resin and the Tg of the tetrahydrofuran-insoluble matter (crosslinked component) of the binder resin are in a specific relationship.

That is, the present invention is a toner having a toner particle including a binder resin and a colorant, wherein the toner has a softening point of at least 100° C. and not more than 150° C., and when Tgt represents a glass transition temperature (° C.) of the toner during a second temperature rise as measured by differential scanning calorimetry (DSC), Tgf represents a glass transition temperature (° C.) of a tetrahydrofuran-insoluble matter of the binder resin during a second temperature rise as measured by differential scanning calorimetry (DSC), and Tgk represents a glass transition temperature (° C.) of a tetrahydrofuran-soluble matter of the binder resin during a second temperature rise as measured by differential scanning calorimetry (DSC), the Tgt, Tgf and Tgk satisfy all three conditions (1) to (3) below:

$$Tgt > Tgf \quad (1)$$

$$Tgt > Tgk \quad (2)$$

$$35° C. \leq Tgf \leq 70° C. \quad (3), \text{ and wherein}$$

the tetrahydrofuran-insoluble matter of the binder resin is the tetrahydrofuran-insoluble matter of the binder resin after the toner has been extracted for 18 hours by Soxhlet extraction using tetrahydrofuran, and the tetrahydrofuran-soluble matter of the binder resin is the tetrahydrofuran-soluble matter of the binder resin after the toner has been extracted for 18 hours by Soxhlet extraction using tetrahydrofuran.

As discussed above, the toner fulfills the conditions of Tgt>Tgf and Tgt>Tgk.

Normally, when a binder resin in a toner is separated into a tetrahydrofuran (hereunder sometimes called THF)-soluble component and a THF-insoluble component, the Tg of the THF-soluble component (linear component) is lower, the Tg of the THF-insoluble component (crosslinked component) is higher, and the Tg of the toner is the average of the two. This means that Tgf>Tgt>Tgk, which does not satisfy formula (1) above.

There are cases such as Japanese Patent Application Publication No. 2015-52697 in which the Tg of the THF-insoluble component is lower and the Tg of the THF-soluble component is higher, but in this case Tgf<Tgt<Tgk, which does not satisfy formula (2) above.

Thus, there have been no conventional toners that satisfy formulae (1) and (2) above. The toner of the present invention satisfies both formula (1) and formula (2).

The THF-soluble component is interpreted as a component derived from a linear component X in the binder resin, while the THF-insoluble component is interpreted as a component derived from a crosslinked component Y in the binder resin.

It is thought that the Tg of the toner is higher than both the Tg of the THF-soluble component (linear component X) and the Tg of the THF-insoluble component (crosslinked component Y) because the linear component X and crosslinked component Y are mutually intertwined to form a network structure in the binder resin constituting the toner.

It is thought that the reason why the Tg of the toner is higher as described above is probably that the crosslinked component Y and linear component X become uniformly entangled at the molecular level in such a way that multiple crosslinked components are physically linked by the linear component, and the whole behaves as a large, integrated gel.

It is thought that because the toner of the present invention contains a physically integrated network structure formed by the linear component X and the crosslinked component Y in the binder resin as discussed above, phase separation of the linear component X from the crosslinked component Y and seepage of the linear component X are suppressed during fixing, and the discharge adhesion properties are dramatically improved.

Moreover, because the linear component X and the crosslinked component Y are uniformly entangled at the molecular level, there is less fixing inhibition by the crosslinked component Y and low-temperature fixability is improved since the crosslinked component Y is efficiently plasticized by the linear component X.

The difference between Tgt and Tgf, (Tgt-Tgf) is preferably at least 3° C., or more preferably at least 4° C. There is no particular upper limit, but preferably the difference is not more than 30° C., or more preferably not more than 25° C.

If Tgt-Tgf is within this range, it is possible to form a more stable network structure, with better discharge adhesion properties and low-temperature fixability.

The relationship of formula (1) above and a value of Tgt-Tgf within the aforementioned range can be obtained by a method of adjusting the added amounts of a terminal modifier or crosslinking agent, and adjusting the monomer constituents of the linear component X and crosslinked component Y in the manufacture of the resin A to the desired ranges. Another method is to control the toner formulation (other resins and magnetic materials, etc.) within the desired range.

The difference between Tgt and Tgk, (Tgt-Tgk) is preferably at least 5° C., or more preferably at least 6° C. There is no particular upper limit, but preferably it is not more than 40° C., or more preferably not more than 35° C.

If Tgt-Tgk is within this range, it is possible to form a more stable network structure, with better discharge adhesion properties and low-temperature fixability.

The relationship of formula (2) above and a value for Tgt-Tgk within the aforementioned range can be obtained by a method of adjusting the added amounts of a terminal modifier or crosslinking agent, and adjusting the monomer constituents of the linear component X and crosslinked component Y in the manufacture of resin A to the desired ranges.

The value of Tgf conforms to 35° C.≤Tgf≤70° C. More preferably it conforms to 40° C.≤Tgf≤65° C.

If Tgf is less than 35° C., the severe storability of the toner is reduced even if a network structure is formed with the linear component X because the Tg of the crosslinked component Y is too low.

If the Tgf exceeds 70° C., on the other hand, the rate of plasticization of the crosslinked component Y by the linear component X cannot keep up, and fixing defects (spot defects) caused by toner missing in spots from the fixed image are particularly likely when solid images are output continuously.

The Tgf can be adjusted by altering the manufacturing conditions and composition of the monomers used in the crosslinked component Y of the binder resin, and by changing the toner manufacturing conditions.

The softening point of the toner is at least 100° C. and not more than 150° C.

If the softening point of the toner is less than 100° C., the toner is likely to adhere to the fixing unit because the viscosity of the toner is too low during fixing, making it difficult to separate the fixed image from the fixing unit, and increasing the likelihood of curling at the end of the image. From the standpoint of curling resistance and toner durability, the softening point of the toner is preferably at least 105° C.

If the softening point of the toner exceeds 150° C., on the other hand, the toner is insufficiently melted during fixing, and the density of half-tone images in particularly may be reduced by friction (friction density decrease). From the standpoint of preventing friction density decrease, the softening point of the toner is preferably not more than 145° C.

The softening point of the toner can be adjusted to within the aforementioned range by adjusting the softening point of the binder resin used in the toner or the toner formulation or manufacturing conditions.

Moreover, Tgt, Tgf and Tgk preferably satisfy the formula (4) below. The durability of the toner is further improved if the formula (4) is satisfied. In particular, the density of solid images is retained better in endurance testing in high-temperature, high-humidity environments.

$$Tgt>Tgf>Tgk \quad (4)$$

One way of satisfying the formula (4) is by strengthening the entanglement between the linear component X and the crosslinked component Y. This can be accomplished for example by selecting a preferred manufacturing method for manufacturing the binder resin as described below, or by selecting the manufacturing conditions for manufacturing the binder resin, or by adjusting the monomers used during manufacture.

The Tgt is preferably at least 50° C. and not more than 70° C.

If the Tgt is at least 50° C., the discharge adhesion properties are further improved during double-sided continuous printing. In terms of low-temperature fixability, the friction density decrease of half-tone images is further suppressed if the Tgt is not more than 70° C.

The Tgt can be controlled by adjusting the toner formulation and manufacturing conditions, as well as the Tg of the binder resin used in manufacturing the toner.

The content of the tetrahydrofuran-insoluble matter of the binder resin is preferably at least 3.0 mass % and not more than 50.0 mass % of the binder resin.

The durability of the toner is further improved if the content of the tetrahydrofuran-insoluble matter is at least 3.0 mass %. Line width variability can be reduced in durability testing in high-temperature, high-humidity environments in particular. The content of the tetrahydrofuran-insoluble matter is more preferably at least 5.0 mass %.

If the content of the tetrahydrofuran-insoluble matter is not more than 50.0 mass %, on the other hand, the low-temperature fixability of the toner is improved, and fixing spot defects in particular are further suppressed. The content of the tetrahydrofuran-insoluble matter is more preferably not more than 40.0 mass %, or still more preferably not more than 30.0 mass %.

The content of the tetrahydrofuran-insoluble matter can be controlled by controlling the toner formulation and manufacturing conditions and the contents of the crosslinked component, crosslinking agent and the like in the binder resin used to manufacture the toner.

In Soxhlet extraction of the toner with toluene, preferably a component derived from a trivalent or higher polyvalent carboxylic acid is bound to the end of the molecular chains of a resin contained in the toluene-insoluble matter of the binder resin after 2 hours of extraction.

Image storability is thereby improved even if fixed images from double-sided printing are stacked and left for a long period of time under pressure in a high-temperature, high-humidity environment.

The investigations of the inventors and others have shown that while almost none of the linear component X remains in the insoluble component of a binder resin obtained from 18 hours of extraction with tetrahyrofuran (THF), the linear component X remains relatively strongly entangled with the crosslinked component Y in an insoluble component of the binder resin obtained from 2 hours of extraction with toluene.

This is attributed not only to the short extraction time, but also to the fact that toluene is somewhat less polar than THF and therefore less able to extract the linear component X. In the linear component X, extraction of a highly-polar, low-molecular component that is highly concentrated at the ends of the molecular chains is particular suppressed.

It is thought that the molecular chains contained in an insoluble component of the binder resin obtained by extracting the toner 2 hours with toluene using a Soxhlet extractor reflect that part of the molecular structure of the linear component that is difficult to separate from the crosslinked component Y because it is strongly physically entwined with the crosslinked component Y.

When a component derived from a trivalent or higher polyvalent carboxylic acid is bound to the end of these molecular chains, the trivalent or higher polyvalent carboxylic acid has an anchor effect that reinforces the physical entanglement between the crosslinked component Y and the linear component X. Due to this effect, the phenomenon of images sticking together due to seepage of the linear component onto the surface of the fixed image is suppressed, and image storability is improved even when fixed images from double-sided printing are stacked under pressure in a high-temperature, high-humidity environment and left for a long period of time.

The following are examples of the trivalent or higher polyvalent carboxylic acid in the component derived from a trivalent or higher polycarboxylic acid: trimellitic acid, pyromellitic acid, 1,2,4-benzenetricarboxylic acid, 1,2,5-benzenetricaroboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, Empol trimer acid, and anhydrides thereof. Of these, trimellitic acid and/or trimellitic anhydride is more preferred.

Preferably the linear component X and the crosslinked component Y are partially or fully entangled with each other to form a network structure in the binder resin of the toner.

The term "network structure" here refers to an interpenetrating network structure, and is a kind of polymer blend in which different kinds of blended polymers are partially or fully entangled with each other, preferably in a multiple network structure.

Preferably a resin A containing the network structure described above formed by the partial or complete entanglement of the linear component X and the crosslinked component Y is used as the binder resin in the toner.

The resin A is explained below.

Examples of the resin A include polyester resins, vinyl resins, epoxy resins and polyurethane resins. To obtain superior low-temperature fixability, the resin A preferably comprises a polyester resin, and more preferably is a polyester resin. That is, the resin A is preferably a polyester resin comprising a linear component and a crosslinked component. When a polyester resin is used in the resin A, another resin may also be included as long as this does not detract from the effects of the invention.

The method for forming a network structure in the resin A is not particularly limited, but preferably for example the following conditions are met in the step of manufacturing the polyester resin in order to facilitate formation of a stable network structure.

A) The linear component X is polymerized first in the first polymerization step. The monomers of the crosslinked component Y are then added and sequentially polymerized in the presence of the linear component X in a second polymerization step.

Specifically, a bivalent alcohol and a bivalent carboxylic acid are first polycondensed to obtain a linear polyester. A bivalent alcohol and a bivalent carboxylic acid together with a trivalent or higher alcohol or trivalent or higher carboxylic acid are then added in the presence of the resulting linear polyester, and polycondensed to obtain the resin A.

B) When the linear component X is polymerized in the first polymerization step, a univalent terminal modifier is added during late polymerization, and the termini of the linear component X are modified with the terminal modifier. This is then transferred to the second polymerization step, and the crosslinked component Y is polymerized.

Specifically, first a bivalent alcohol and a bivalent carboxylic acid are polycondensed to obtain a linear polyester. A univalent terminal modifier is then added to modify the termini of the linear polyester. A bivalent alcohol and a bivalent carboxylic acid together with a trivalent or higher alcohol or trivalent or higher carboxylic acid are then added and polycondensed to obtain the resin A.

C) In the second polymerization step, when the monomers of the crosslinked component Y are added in the presence of the linear component X to perform a polymerization reaction, a trivalent crosslinking agent is added at any stage from initial polymerization to late polymerization to promote a crosslinking reaction.

Specifically, first a bivalent alcohol and a bivalent carboxylic acid are polycondensed to obtain a linear polyester. A univalent terminal modifier is then added to modify the termini of the linear polyester. Next, a bivalent alcohol and a bivalent carboxylic acid are added to perform a second polycondensation. A trivalent or higher alcohol or trivalent or higher carboxylic acid is added at any point from initial polymerization to late polymerization during this second polycondensation, and polycondensation is performed to obtain the resin A.

D) In a manufacturing method conforming to both B) and C) above, the crosslinking agent in the second polymerization step is added during the second half of polymerization of the crosslinked component Y to cause a crosslinking reaction of the crosslinked component Y, while at the same time an exchange reaction is performed to convert the termini of the linear component X from the terminal modifier to the crosslinking agent.

Specifically, first a bivalent alcohol and a bivalent carboxylic acid are polycondensed to obtain a linear polyester. A univalent terminal modifier is then added to modify the termini of the linear polyester. Next, a bivalent alcohol and a bivalent carboxylic acid are added, and a second polycondensation is performed. A trivalent or higher alcohol or trivalent or higher carboxylic acid is then added, and polycondensation is performed to convert the termini of the linear polyester from the terminal modifier to the trivalent or higher alcohol or trivalent or higher carboxylic acid, and obtain the resin A.

E) In a manufacturing method conforming to both B) and C) above, a part of the crosslinking agent is added during initial polymerization in the second polymerization step to promote a polymerization reaction, after which a part of the crosslinking agent is added during late polymerization to promote a crosslinking reaction of the crosslinked component Y while at the same time an exchange reaction is performed to convert the termini of the linear component X from the terminal modifier to the crosslinking agent.

Specifically, first a bivalent alcohol and a bivalent carboxylic acid are polycondensed to obtain a linear polyester. A univalent terminal modifier is then added to modify the termini of the linear polyester. Next, a bivalent alcohol and a bivalent carboxylic acid are added together with a trivalent or higher alcohol or trivalent or higher carboxylic acid, and a second polycondensation is performed. A trivalent or higher alcohol or trivalent or higher carboxylic acid is then added and polycondensation is performed to convert the termini of the linear polyester from the terminal modifier to the trivalent or higher alcohol or trivalent or higher carboxylic acid, and obtain the resin A.

Polymerizing the crosslinked component in the presence of the linear component as in the method A) is desirable because it facilitates the formation of a network structure in which the linear component and the crosslinked component are entangled to a high degree.

Modifying the termini of the linear component with a univalent terminal modifier as in the method B) before adding the monomers of the crosslinked component to cause a polymerization reaction is also desirable because this makes it easier to cause polymerization of the crosslinked component while maintaining the structure of the linear component.

The terminal modifier is not particularly limited, but is preferably a univalent carboxylic acid or univalent alcohol, or a derivative of these.

Of these, a univalent aromatic carboxylic acid (benzoic acid) and/or its derivative is desirable because in this case the structure of the linear component is less likely to be damaged by hydrolysis or a transesterification reaction in the second polymerization step, facilitating the formation of a stable network structure.

After addition of the terminal modifier, it is desirable to sufficiently advance the reaction between the terminal modifier and the termini of the linear component.

In order to inhibit hydrolysis of the linear component and facilitate the formation of a stable network structure in the second polymerization step, the added amount of the terminal modifier is preferably at least 3.0 mol parts and not more than 14.0 mol parts, or more preferably at least 5.0 mol parts and not more than 13.5 mol parts given 100 mol parts as the total mol amount of the linear component apart from the terminal modifier.

A trivalent crosslinking agent is preferably added to cause a crosslinking reaction at any stage from initial to late polymerization as in the method of C) when adding the monomers of the crosslinked component Y in the presence of the linear component X to cause a polymerization reaction.

In this way, the linear component X and the crosslinked component Y can be more easily entangled with each other to form an intertwined network structure. Although this is not a limitation, the crosslinking agent may be added during both initial and late polymerization to make it easier for the linear component X and the crosslinked component Y to form a mutually intertwined network structure.

The crosslinking agent is not particularly limited, but is preferably a trivalent or higher polyvalent carboxylic acid, a trivalent or higher polyvalent alcohol, or a derivative of these.

Examples of trivalent or higher polyvalent alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of trivalent or higher polyvalent carboxylic acid components include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, Empol trimer acid, and anhydrides of these.

Of these, trimellitic acid and/or trimellitic anhydride is more preferred because it is highly reactive as a crosslinking agent, facilitating the formation of a uniform crosslinked structure.

As described in the method of D), is also desirable to add the crosslinking agent during late polymerization of the crosslinked component Y in the second polymerization step to cause a crosslinking reaction of the crosslinked component Y while simultaneously causing an exchange reaction to convert the termini of the linear component X from the terminal modifier to the crosslinking agent.

This method facilitates the binding of a component derived from a trivalent or higher polyvalent carboxylic acid to the ends of the molecular chains of a resin contained in the toluene-insoluble matter of the toner. The pressurized storability of the image is thereby improved as discussed above.

It is also desirable to add a part of the crosslinking agent during initial polymerization in the second polymerization step to promote a polymerization reaction, and then add a part of the crosslinking agent during late polymerization to promote a crosslinking reaction of the crosslinked component Y as described in the method of E).

Because the crosslinked component Y branches while undergoing polycondensation when a crosslinking agent is added during initial polymerization, this is desirable for forming a strong network structure with the linear component X. Addition of the crosslinking agent during late polymerization is also desirable because it assists entanglement with the linear component X by causing the crosslinked component Y to form multiple crosslinked structures. It also facilitates binding of a component derived from the trivalent or higher polyvalent carboxylic acid to the ends of the molecular chains contained in the toluene-insoluble matter.

Moreover, because the ends of the linear component X can also be converted from the terminal modifier to the crosslinking agent as discussed above, the linear component X entangled with the network of the crosslinked component Y can be maintained with less risk of detachment, resulting in good storability of the image under pressure.

To easily form a robust network structure with stronger entanglement between the linear component X and the crosslinked component Y in the second polymerization step, the total added ratio of the crosslinking agent is preferably at least 8.0 mol parts and not more than 23.0 mol parts, or more preferably at least 10.0 mol parts and not more than 20.0 mol parts, or still more preferably at least 14.0 mol parts and not more than 19.0 mol parts given 100 mol parts as the total amount of the monomers other than the crosslinking agent of the crosslinked component Y.

If the amount of the crosslinking agent added beginning from initial polymerization is within a specific range, a uniform branched structure is formed in the crosslinked component Y, and physical entanglement with the linear component X is reinforced. The added amount of the crosslinking agent from initial polymerization is preferably at least 3.0 mol parts and not more than 20.0 mol parts, or more preferably at least 5.5 mol parts and not more than 15.0 mol parts, or still more preferably at least 5.5 mol parts and not more than 10.0 mol parts given 100 mol parts as the total amount of the monomers other than the crosslinking agent of the crosslinked component Y.

Adding a greater amount of the crosslinking agent during late polymerization is preferable for purposes of promoting an exchange reaction of the crosslinking agent for the terminal modifier on the linear component X. Controlling the added amount within a specific range serves to suppress residual, unreacted crosslinking agent and to stabilize the charging stability in high-temperature, high-humidity environments.

The amount of the crosslinking agent added during late polymerization is preferably at least 2.0 mol parts and not more than 20.0 mol parts, or more preferably at least 4.0 mol parts and not more than 15.0 mol parts, or still more preferably at least 8.0 mol parts and not more than 13.0 mol parts given 100 mol parts as the total amount of the monomers other than the crosslinking agent of the crosslinked component Y.

When a polyester resin is used as the resin A, the following are examples of the alcohol component and acid component constituting the polyester resin.

The following bivalent alcohols are examples of the alcohol component: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and aromatic diols such as the bisphenol represented by formula [I] below and its derivatives and the diols represented by formula [II] below.

(I)

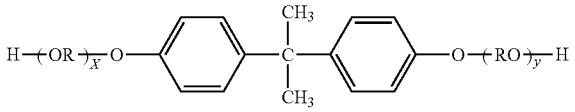

In the formula, R represents an ethylene or propylene group, each of x and y represents an integer of 0 or greater, and the average value of x+y is at least 0 and not more than 10.

(II)

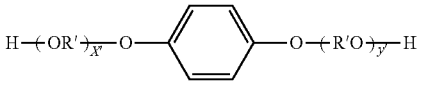

In the formula, R' is

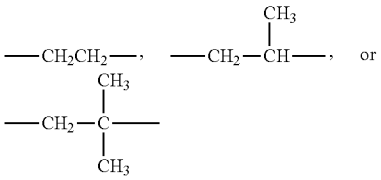

each of x' and y' is an integer of 0 or greater, and the average value of x'+y' is at least 0 and not more than 10.

The following bivalent carboxylic acids are examples of the acid component: benzenedicarboxylic acids such as phthalic acid, terephthalic acid, isophthalic acid and phthalic anhydride, and anhydrides of these; alkyldicarboxylic acids such as succinic acid, adipic acid, sebacic acid and azelaic acid, and anhydride of this; succinic acid substituted with $C_{6-18}$ alkyl groups or $C_{6-18}$ alkenyl groups, or anhydrides of these; and unsaturated dicarboxylic acids such as fumaric acid, maleic acid, citraconic acid and itaconic acid, and anhydrides of these.

The trivalent or higher polyvalent alcohol component may be similar to the trivalent or higher polyvalent alcohol components given as examples of the crosslinking agent used in synthesizing the resin A.

The trivalent or higher polyvalent carboxylic acid component may also be similar to the trivalent or higher polyvalent carboxylic acid components given as examples of the crosslinking agent used in synthesizing the resin A.

Another resin may also be included in the toner to the extent that it does not detract from the effects of the invention. The polyester resin may also be a hybrid resin of a polyester resin and a vinyl resin such as a styrene-acrylic resin.

The glass transition temperature (Tg) of the resin A is not particularly limited as long as the Tgt is adjusted to within the aforementioned range, but is preferably at least 50° C. and not more than 75° C. from the standpoint of storability of the raw materials. For the same reasons, the softening point of the resin A is preferably at least 90° C. and not more than 170° C.

From the standpoint of toner durability and fixing performance, the weight-average molecular weight (Mw) of the resin A is preferably at least 8,000 and not more than 1,200,000, or more preferably at least 40,000 and not more than 300,000.

The binder resin contained in the toner particle may be of only one kind (resin A), but may also include a resin B fulfilling the following specifications i) and ii) below. This serves to further improve the storability of the fixed image as well as the low-temperature fixability of the toner.

i) Has a polyester structure ii) Has a partial structure represented by $R_1$—O— or $R_2$—COO—

(In the structural formula, $R_1$ represents a group having a structure in which a hydrogen atom is removed of a $C_{12-102}$ aliphatic hydrocarbon. $R_2$ represents a group having a structure in which a hydrogen atom is removed of a $C_{11-101}$ aliphatic hydrocarbon.)

The content of the resin A in the binder resin is preferably at least 15 mass %, or more preferably at least 20 mass %, or still more preferably at least 25 mass %. There is no upper limit, but since the resin B is preferably included, the content of the resin A is preferably not more than 85 mass %, or more preferably not more than 80 mass %, or still more preferably not more than 75 mass %.

If the resin B has i) a polyester structure, it disperses uniformly in the network structure formed by the linear component X and crosslinked component Y as described above, and the mutual dispersibility of the linear component X and crosslinked component Y is further improved.

Moreover, if the resin B has ii) a partial structure represented by $R_1$—O— or $R_2$—COO—, this facilitates the physical entanglement of the resin B with the network structure.

This means that a good dispersion state of the linear component X and crosslinked component Y can be maintained and the images can be prevented from sticking together even under severe conditions in which fixed images are left under pressure in a high-temperature, high-humidity environment.

Low-temperature fixability is also improved because the ii) $R_1$—O— or $R_2$—COO— structure at the ends of the molecular chains of the resin B efficiently plasticizes the crosslinked component Y during fixing.

To achieve even better low-temperature fixability and obtain a toner with good image storability under pressure, $R_1$ is more preferably a group having a structure in which a hydrogen atom is removed of a $C_{25-75}$ aliphatic hydrocarbon. Similarly, $R_2$ is more preferably a group having a structure in which a hydrogen atom is removed of a $C_{24-74}$ aliphatic hydrocarbon.

Because the aliphatic hydrocarbon has a large carbon number, the carbon number is sometimes called the "peak carbon number". For example, the $C_{12-102}$ aliphatic hydrocarbon can also be called an aliphatic hydrocarbon with a peak carbon number of 12 to 102. In this case, the "peak carbon number" is the number of carbon atoms calculated from the main peak molecular weight of the aliphatic hydrocarbon as measured by gel permeation chromatography (GPC).

In order to increase these effects by uniformly dispersing the resin B in the network structure and entangling the linear component X and crosslinked component Y, the resin B is preferably a non-crosslinkable resin that is substantially not crosslinked.

The glass transition temperature (Tg) of this resin B is not particularly limited as long as the Tgt is adjusted to within the aforementioned range, but is preferably at least 45° C. and not more than 65° C. from the standpoint of storability of the raw materials and low-temperature fixability of the resulting toner. For these reasons, the softening point of the resin B is preferably at least 80° C. and not more than 120° C.

From the standpoint of toner durability and fixing performance, the weight-average molecular weight (Mw) of the resin B is preferably at least 3,000 and not more than 20,000, or more preferably at least 4,000 and not more than 15,000.

The mass ratio of the resins A and B in the binder resin (resin A:resin B) is preferably 15:85 to 85:15, or more preferably 20:80 to 80:20, or still more preferably 25:75 to 75:25.

When the toner particle contains the resin B and the resin B is a non-crosslinkable resin, the THF-insoluble component derives primary from the crosslinked component Y, while the THF-soluble component derives from a mixture of the linear component X and the resin B.

Even if the THF-soluble component is derived from a mixture in this way, it is believed that a binder resin containing the resin B can still form an overall network structure because the relationships described above prevail. It is thought that effects such as low-temperature fixability, discharge adhesion properties, severe storability and curling resistance can be achieved in this way.

The toner particle may also contain a release agent. The release agent is not limited as long as it increases the release properties between the fixing sleeve and the toner image, but preferred release agents are explained below.

Examples include polyolefin copolymers and aliphatic hydrocarbon waxes such as polyolefin wax, microcrystalline wax, paraffin wax and Fischer-Tropsch wax. These release agents include those that have been given a sharp molecular weight distribution by the press sweating method, solvent method, recrystallization method, vacuum distillation method, supercritical gas extraction method or melt crystallization method.

The following are specific examples of the release agent: Viscol® 330-P, 550-P, 660-P, TS-200 (Sanyo Chemical Industries, Ltd.), High Wax 400P, 200P, 100P, 410P, 420P, 320P, 220P, 210P, 110P (Mitsui Chemicals, Inc.), Sasol H1, H2, C80, C105, C77 (Schumann Sasol), HNP-1, HNP-3, HNP-9, HNP-10, HNP-11, HNP-12 (Nippon Seiro Co., Ltd.), Unilin® 350, 425, 550, 700, Unisid® 350, 425, 550, 700 (Toyo ADL Corporation), and wood wax, beeswax, rice wax, candelilla wax and carnauba wax (available from Cerarica Noda Co, Ltd.).

An existing method may be selected for adding the release agent, which may be added either during toner particle manufacture or during manufacture of the binder resin. These release agents may be used individually or combined.

The content of the release agent is preferably at least 0.5 mass parts and not more than 20.0 mass parts, or more preferably at least 0.5 mass parts and not more than 10.0 mass parts per 100.0 mass parts of the binder resin.

From the standpoint of toner durability and low-temperature fixability, the melting point of the release agent is preferably at least 60° C. and not more than 120° C., or more preferably at least 70° C. and not more than 110° C.

The toner may also be a magnetic one-component toner.

When the toner is used as a magnetic one-component toner, a magnetic material is preferably used as the colorant. Examples of magnetic materials that are contained in magnetic one-component toners include magnetic iron oxides such as magnetite, maghemite and ferrite, and magnetic iron oxides containing other metal oxides; metals such as Fe, Co and Ni, alloys of these metals with metals such as Al, Co, Cu, Pb, Mg, Ni, Sn, Zn, Sb, Be, Bi, Cd, Ca, Mn, Se, Ti, W and V, and mixtures of these.

The magnetic material is preferably subjected to shearing force during manufacture to temporarily loosen the magnetic material in order to improve its fine dispersibility in the toner particle.

The number-average particle diameter of these magnetic materials is preferably at least 0.05 μm and not more than 2.0 μm, or more preferably at least 0.05 μm and not more than 0.50 μm.

When the colorant is a magnetic material, the content of the magnetic material is preferably at least 35 mass parts and not more than 120 mass parts, or more preferably at least 40 mass parts and not more than 100 mass parts per 100 mass parts of the binder resin from the standpoint of the toner discharge adhesion properties, curl resistance and fixability.

A conventionally known pigment or dye may also be included as necessary to adjust the color of the toner.

The toner particle may also contain a charge control agent to further improve the charge uniformity.

When a polyester resin is used as the binder resin, the charge control agent is preferably an organometallic complex or chelate compound with a central metal that reacts easily with the acid groups or hydroxyl groups at the ends of the binder resin. For example, a monoazo metal complex; an acetylacetone metal complex; or a metal complex or metal salt of an aromatic hydroxycarboxylic acid or aromatic dicarboxylic acid can be used by preference.

Specific examples include Spilon Black TRH, T-77, T-95 (Hodogaya Chemical Co., Ltd.), and Bontron® S-34, S-44, S-54, E-84, E-88, E-89 (Orient Chemical Industries Co., Ltd.).

One kind of charge control agent may be used, or two or more kinds may be combined.

The small particle fraction of the toner, which is represented as the numerical percentage of particles with a circle-equivalent diameter of less than 1.985 μm, is preferably as small as possible in order to achieve better line width uniformity.

When the toner has an integrated network structure formed by the linear component X and crosslinked component Y, the toner tends not to melt completely during fixing, so that the form of the toner is retained to a certain extent when it is fixed.

If there is variation in the number of developed toner particles in the vertical and horizontal lines, it is likely to be manifested as a variation in line width.

When the small particle fraction of the toner is small, the adhesive force between toner particles is reduced, and during development the toner is more likely to be developed as individual particles, so that the number of toner particles developed in the vertical and horizontal lines can be equalized, resulting in good uniformity of the vertical and horizontal line widths.

The small particle fraction is preferably not more than 8.0%, or more preferably not more than 5.0%. There is no particular lower limit, but preferably the fraction is at least 0.1%, or more preferably at least 0.3%, or still more preferably at least 2.0%.

The method for manufacturing the toner is not particularly limited, and a conventional known manufacturing method may be adopted.

Although this is not a particular limitation, the toner preferably contains a toner particle obtained via a melt kneading step, and a preferred embodiment of the method for manufacturing the toner particle is explained below.

One example of a method of manufacturing the toner particle is a pulverization method comprising a raw material mixing step in which a binder resin and a colorant are mixed together with a release agent or other additive as necessary, a melt kneading step in which the resulting mixture is melt kneaded, and a step in which the resulting melt kneaded product is cooled and solidified, and then pulverized.

For example, in the raw material mixing step, as materials of toner particle, a binder resin (such as resin A and resin B), a colorant and, as necessary, a release agent or other additive are weighed in specific amounts, compounded together and mixed. Examples of the mixing apparatus include a double-cone mixer, V-type mixer, drum mixer, super mixer, FM mixer, Nauta mixer, Mechano Hybrid (Nippon Coke & Engineering Co., Ltd.) and the like.

The mixed materials can then be melt kneaded and subjected to shearing force to uniformly disperse the resin B while maintaining the structure of the network structure in the binder resin. The dispersibility of the colorant, release agent and the like in the toner particle can be improved at the same time.

A batch kneading apparatus such as a pressure kneader or Banbury mixer or a continuous kneading apparatus may be used in the melt kneading step. A twin-screw extruder is desirable for continuous production, and for obtaining a homogenous mixture.

Specific examples include a TEX kneader (The Japan Steel Works, Ltd.), KTK twin-screw extruder (Kobe Steel, Ltd.), TEM twin-screw extruder (Toshiba Machine Co., Ltd.), PCM kneader (Ikegai Iron Works Co., Ltd.), twin-screw extruder (KCK) and the like.

The ratio of the kneading zone relative to the total length of the kneading screw (sometimes called simply the kneading ratio) is preferably at least 20% and not more than 50%. If the ratio is at least 20% and not more than 50%, it is possible to suppress heat generation and excess shearing force during kneading while applying a suitable degree of shearing force to the binder resin, colorant, release agent and the like. Material dispersibility is improved as a result, and dot reproducibility is good because scattering is suppressed during toner development.

Because the dispersibility of the other materials can be improved without damaging the network structure in the binder resin, moreover, the softening point of the resulting toner can be easily adjusted within the desired range, and it is possible to suppress a decrease in the THF-insoluble component due to melt kneading.

In the cooling step, the resulting melt kneaded product can be rolled between two rolls or the like, and cooled with water or the like.

The resulting cooled product can then be pulverized to the desired particle size in the pulverization step. In this pulverization step, the material can first be coarsely pulverized with a crushing apparatus such as a crusher, hammer mill or feather mill, and then finely pulverized with a pulverizing apparatus such as a Kryptron system (Kawasaki Heavy Industries, Ltd.), Super Rotor (Nisshin Engineering Inc.), Turbo Mill (Turbo Kogyo Co., Ltd.) or air jet system.

This can then be classified as necessary with a sieving or classifying apparatus such as an Elbow Jet (Nittetsu Mining Co., Ltd.) using inertial classification, a Turboplex (Hosokawa Micron Corporation) using centrifugal classification, a TSP Separator (Hosokawa Micron Corporation) or a Faculty (Hosokawa Micron Corporation).

After pulverization, as required, the toner particle can also be subjected to surface treatment such as spheronization with a Hybridization system (Nara Machinery Co., Ltd.), Mechano-fusion system (Hosokawa Micron Corporation), Faculty (Hosokawa Micron Corporation) or Meteor Rainbow MR Type (Nippon Pneumatic Mfg. Co., Ltd.).

The method for reducing the small particle fraction of the toner is not particularly limited, but for example if the toner is subjected to mechanical surface treatment with a Faculty after pulverization, possible methods include increasing the number of mechanical treatment parts (hammers), or decreasing the loaded amount per batch, or prolonging the treatment time.

The small particle fraction can also be reduced by spheronization treatment with hot air using a Meteor Rainbow or the like. In this case, the hot air temperature can be adjusted to within the range of between 20° C. below the softening point of the toner and 100° C. above the softening point of the toner.

Following this step, another external additive can be added as necessary to the surfaces of the toner particles, which can then be classified with a classifier or sieve as necessary to obtain a toner.

The mixing apparatus used in the external addition step may be an FM mixer (Nippon Coke & Engineering Co., Ltd.); Super Mixer (Kawata Co., Ltd.); Ribocone (Okawara Mfg. Co., Ltd.); Nauta Mixer, Turbulizer or Cyclomix (Hosokawa Micron Corporation); Spiral Pin Mixer (Pacific Machinery & Engineering Co., Ltd.); or Loedige mixer (Matsubo Corporation) or the like.

The mixing time in the external addition step is preferably adjusted to the range of at least 0.5 minutes and not more than 10.0 minutes, or more preferably at least 1.0 minutes and not more than 5.0 minutes from the standpoint of the dispersibility of the external additive.

A flowability improver with a small diameter (a number-average particle diameter of the primary particle of at least 5 nm and not more than 30 nm) may be added as an external additive to improve the flowability and charging performance of the toner.

Examples of flowability improvers include fluorine resin fine particles such as vinylidene fluoride fine particles and polytetrafluoroethylene fine particles; inorganic fine particles such as wet silica, dry silica and other silica fine particles, titanium oxide fine particles and alumina fine particles; treated fine particles obtained by surface treating such inorganic fine particles with silane compounds, titanium coupling agents, silicone oil or the like; oxide fine particles such as zinc oxide and tin oxide; composite oxide fine particles such as strontium titanate, barium titanate, calcium titanate, strontium zirconate and calcium zirconate; and fine particles of carbonate compounds such as calcium carbonate and magnesium carbonate.

Of these, fine particles produced by vapor phase oxidation of silicon halide compounds (so-called dry silica or fumed silica) are preferred as flowability improvers. For example, a thermal decomposition oxidation reaction of silicon tetrachloride gas in an oxyhydrogen flame may be used, and the basic reaction formula is as follows.

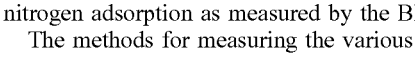

$$SiCl_4+2H_2+O_2 \rightarrow SiO_2+4HCl$$

In this manufacturing step, composite fine particles of silica with another metal oxide can be obtained by using another metal halide compound such as aluminum chloride or titanium chloride together with the silicon halide compound, and these particles are also considered silica fine particles.

Treated silica fine particles obtained by hydrophobic treatment of silica fine particles produced by vapor phase oxidation of a silicon halide compound are more preferred as the flowability improver.

The flowability improver preferably has a specific surface area of at least 30 $m^2/g$ and not more than 300 $m^2/g$ by nitrogen adsorption as measured by the BET method.

The methods for measuring the various physical properties in the present invention are described below.

<Method for Measuring Glass Transition Temperature>

The glass transition temperature is measured in accordance with ASTM D3418-82, using a Q2000 differential scanning calorimeter (DSC) (TA Instruments).

The melting points of indium and zinc are used for temperature correction of the device detection part, and the heat of fusion of indium is used for correction of the calorific value.

Specifically, about 2 mg of sample is weighed precisely into an aluminum pan, and an empty aluminum pan is used for reference.

Measurement is performed within a temperature range of −10° C. to 200° C. at a ramp rate of 10° C./min.

During measurement, the temperature is first increased from −10° C. to 200° C. at a ramp rate of 10° C./min, and then decreased from 200° C. to −10° C. at a rate of 10° C./min.

The temperature is then increased again from −10° C. to 200° C. at a ramp rate of 10° C./min.

A DSC curve is obtained within the range of 20° C. to 100° C. during this second temperature rise.

The temperature (° C.) at the point of intersection between the DSC curve and a line midway between the baselines prior to and subsequent to the appearance of a change in specific heat in the DSC curve during this second temperature rise is taken as the glass transition temperature.

<Method for Measuring Softening Point>

The softening point is measured using a constant load extrusion-type capillary rheometer (Flow Tester CFT-500D flow characteristics evaluation device, Shimadzu Corporation) in accordance with the attached manual. With this device, the temperature of a measurement sample packed in a cylinder is raised to melt the sample while a fixed load is applied with a piston from the top of the measurement sample, the melted measurement sample is extruded from a die at the bottom of the cylinder, and a flow curve can then be obtained showing the relationship between temperature and the amount of descent of the piston during this process.

The softening point is the "melting temperature by the ½ method" as described in the manual attached to the Flow Tester CFT-500D flow characteristics evaluation device. The melting temperature by the ½ method was calculated as follows.

First, ½ the difference between the descent of the piston upon completion of outflow (Smax) and the descent of the piston at the beginning of outflow (Smin) is calculated and given as X (X=(Smax-Smin)/2). The temperature in the flow curve at which the descent of the piston is the sum of X and Smin is the melting temperature by the ½ method.

For the measurement sample, about 1.0 g of toner is compression molded for about 60 seconds at about 10 MPa in a 25° C. environment with a tablet molding compressor (for example NT-100H, NPa System Co., Ltd.) to obtain a cylinder about 8 mm in diameter.

The CFT-500D measurement conditions are as follows.

Test mode: Heating method
Ramp rate: 4.0° C./min
Initial temperature: 40° C.
Achieved temperature: 200° C.
Measurement interval: 1.0° C.
Piston cross-sectional area: 1.000 $cm^2$
Test load (piston load): 10.0 kgf (0.9807 MPa)
Preheating time: 300 seconds
Die hole diameter: 1.0 mm
Die length: 1.0 mm <Method for Measuring Weight-Average Particle Diameter (D4) of Toner Particle>

The weight-average particle diameter (D4) of the toner particle was calculated as follows. A Coulter Counter Multisizer® 3 (Beckman Coulter, Inc.) precision particle size distribution measurement device using the pore electrical resistance method and equipped with a 100 μm aperture tube was used as the measurement equipment. The Multisizer 3 Version 3.51 dedicated software (Beckman Coulter, Inc.) attached to the device was used for setting the measurement conditions and analyzing the measurement data. Measurement was performed with 25,000 effective measurement channels.

A solution of special-grade sodium chloride dissolved to a concentration of about 1 mass % in ion-exchange water, such as "Isoton II" (Beckman Coulter, Inc.), may be used as the electrolytic solution for measurement.

The following settings are performed on the dedicated software prior to measurement and analysis.

On the "Change Standard Operating Method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the threshold/noise level measurement button. The current is set to 1,600 μA, the gain to 2 and the electrolytic solution to Isoton II, and a check is entered for aperture tube flush after measurement.

On the "Conversion Setting from Pulse to Particle Diameter" screen of the dedicated software, the bin interval is set to the logarithmic particle diameter, the particle diameter bin is set to the 256 particle diameter bin, and the particle diameter range is set to 2 μm to 60 μm.

The specific measurement methods are as follows.

(1) About 200 mL of the aqueous electrolytic solution is placed in a 250 mL glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 mL of the aqueous electrolytic solution is placed in a 100 mL glass flat-bottomed beaker, and approximately 0.3 mL of a diluted solution of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted about 3 times by mass with ion-exchange water is added thereto as a dispersant.

(3) An "Ultrasonic Dispersion System Tetora 150" ultrasonic disperser (Nikkaki-Bios Co., Ltd.) with an electric output of 120 W is prepared, in which two oscillators with an oscillation frequency of 50 kHz are built-in with the phases of the oscillators shifted by 180° to one other. About 3.3 L of ion-exchange water is placed in the water bath of the ultrasonic disperser, and about 2 mL of the CONTAMINON N is added to this water bath.

(4) The beaker of (2) is set in a beaker-fixing hole of the ultrasonic disperser, and the ultrasonic disperser is operated. The height position of the beaker is adjusted so as to maximize the resonance state of the surface of the electrolytic solution in the beaker.

(5) With the electrolytic solution in the beaker of (4) exposed to ultrasound waves, approximately 10 mg of the toner particle is added little by little to the electrolytic solution, and dispersed. Ultrasonic dispersion treatment is then continued for a further 60 seconds. During the ultrasonic dispersion, the water temperature of the water bath is adjusted as necessary so as to be at least 10° C. and not more than 40° C.

(6) Using a pipette, the electrolytic solution of (5) containing the dispersed toner particle is added dropwise to the round-bottomed beaker of (1) disposed on the sample stand, and the measurement concentration is adjusted to about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the analysis/volume statistical value (arithmetic average) screen when graph/vol % is set by the dedicated software.

<Method for Measuring Small Particle Fraction of Toner>

The small particle fraction of the toner is measured under the measurement and analysis conditions for calibration operations, using an FPIA-3000 flow-type particle image analyzer (Sysmex Corporation).

The specific measurement methods are as follows. First, about 20 mL of ion-exchange water from which solid impurities have been removed in advance is placed in a glass container.

About 0.2 mL of a diluted solution of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted about 3 times by mass with ion-exchange water is then added as a dispersant.

About 0.02 g of the measurement sample is then added, and dispersed for 2 minutes with an ultrasonic disperser to obtain a dispersion for measurement. Cooling is performed as necessary during this process so that the temperature of the dispersion is at least 10° C. and not more than 40° C.

Using a tabletop ultrasonic washer and disperser with an oscillation frequency of 50 kHz and an electrical output of 150 W (such as VS-150, Velvo-Clear) as the ultrasonic disperser, a predetermined amount of ion-exchange water is placed in the water bath, and about 2 mL of Contaminon N is added to this water bath.

A flow type particle image analyzer with UPlanApro (magnification 10×, aperture 0.40) mounted as an objective lens is used for measurement, and particle sheath (PSE-900A, Sysmex Corporation) is used as the sheath liquid. A dispersion prepared by the procedures described above is introduced into the flow type particle image analyzer, and 3,000 toner particles are measured in HPF measurement mode and in total count mode. The binarization threshold during particle analysis is set to 85%, and the analyzed particle diameters are limited to equivalent circle diameters of at least 1.985 μm and less than 39.69 μm.

The small particle fraction (number%), which is the numerical percentage of toner with a circle-equivalent diameter of less than 1.985, is determined from the analysis results.

<Methods for Extracting and Measuring Contents of Tetrahydrofuran (THF)-Insoluble and THF-Soluble Components of Binder Resin>

About 1.5 g of toner is weighed exactly (W1 [g]), placed in a pre-weighed cylindrical paper filter (trade name: No. 86R, size 28×100 mm, Advantec Toyo Kaisha, Ltd.), and set in a Soxhlet extractor.

This is extracted for 18 hours using 200 mL of tetrahydrofuran (THF) as the solvent. Extraction is performed at a reflux speed at which the solvent extraction cycle repeats about once every approximately 5 minutes.

After completion of extraction, the cylindrical filter is removed and air dried, and then vacuum dried for 8 hours at 40° C., and the mass of the cylindrical paper filter containing the extraction residue is weighed and the mass of the cylindrical filter subtracted to calculate the mass of the extraction residue (W2 [g]).

Next, the content of the components other than the binder resin (W3 [g]) is determined by the following procedures.

About 2 g of toner is weighed exactly (Wa [g]) into a pre-weighed 30 mL magnetic crucible.

The magnetic crucible is placed in an electrical furnace and heated for about 3 hours at about 900° C., left to cool in the electrical furnace, and then left to cool for at least 1 hour in a desiccator at normal temperature, the mass of the crucible containing the incineration residue ash is weighed, and the mass of the crucible is subtracted to calculate the incineration residue ash component (Wb [g]).

The mass (W3 [g]) of the incineration residue ash component in the sample W1 [g] is then calculated according to the following formula (A).

$$W3 = W1 \times (Wb/Wa) \quad \text{(A)}$$

In this case, the content of the THF-insoluble component of the binder resin (mass %) is determined by the following formula (B).

$$\text{THF-insoluble component of binder resin (mass \%)} = \{(W2-W3)/(W1-W3)\} \times 100 \quad \text{(B)}$$

<Method for Measuring Tgt, Tgf, Tgk>

The Tgt is measured using the sample as the toner, by the "Method for measuring glass transition temperature" above.

The Tgf is measured by the "Method for measuring glass transition temperature" above using as the sample the extraction residue remaining on the cylindrical paper filter (THF-insoluble component of binder resin) as described in the "Methods for extracting and measuring contents of tetrahydrofuran (THF)-insoluble and THF-soluble components of binder resin" above.

The Tgk is measured by the "Method for measuring glass transition temperature" above using as the same the THF-soluble component of the binder resin, which is obtained by the following methods.

In the "Methods for extracting and measuring contents of tetrahydrofuran (THF)-insoluble and THF-soluble components of binder resin" above, the THF-soluble component extracted with the Soxhlet extractor is taken and placed in an eggplant flask after completion of extraction, the THF is distilled off for 4 hours at a water temperature of 40° C. with a rotary evaporator equipped with a water bath and then vacuum dried for 8 hours at 40° C., and the residue remaining in the eggplant flask is taken as the THF-soluble component of the binder resin.

<Method for Confirming Binding of Component Derived from Trivalent or Higher Polyvalent Carboxylic Acid to Ends of Molecular Chains in Toluene-Insoluble Matter of Binder Resin>

About 1.5 g of the toner is weighed precisely, placed in a pre-weighed cylindrical paper filter (trade name: No. 86R, size 28×100 mm, Advantec Toyo Kaisha, Ltd.), and set in a Soxhlet extractor.

This is extracted for 2 hours using 200 mL of toluene as the solvent. Extraction is performed at a reflux rate at which the solvent extraction cycle repeats about once every approximately 5 minutes.

After completion of extraction, the cylindrical filter is removed and air dried, and then vacuum dried for 3 hours at 40° C., and the extraction residue remaining on the cylindrical paper filter is sampled and taken as the toluene-insoluble matter of the binder resin.

Binding of the component derived from a trivalent or higher polyvalent carboxylic acid to the ends of the molecular chains in the toluene-insoluble matter of the binder resin is then confirmed with a MALDI-TOFMS (Bruker Daltonics Ultra flexstream).

2 mg of the toluene-insoluble matter of the binder resin (sample) is weighed precisely, and 2 mL of chloroform is added to dissolve the sample and prepare a sample solution.

Next, 20 mg of 2,5-dihydroxybenzoic acid (DHBA) is weighed precisely, and dissolved by addition of 1 mL of chloroform to prepare a matrix solution.

3 mg of sodium trifluoroacetate (NaTFA) is then weighed precisely, and dissolved by addition of 1 mL of acetone to prepare an ionization aid solution.

25 μL of the sample solution, 50 μL of the matrix solution and 5 μL of the ionization aid solution thus prepared are mixed, dripped onto a sample plate for MALDI analysis, and dried to obtain a measurement sample.

In the resulting mass spectrum, each peak in the oligomer region (m/Z 2,000 or less) is attributed, and the presence or absence of a peak corresponding to the composition of a component derived from a trivalent or higher polyvalent carboxylic acid bound to the end of the molecular chains of the resin is confirmed. It is thus possible to determine whether or not a component derived from a trivalent or higher polyvalent carboxylic acid has bound to the end of the molecular chains of a resin contained in the toluene-insoluble matter of the binder resin.

EXAMPLES

The present invention is explained in detail below using examples and comparative examples, but the present invention is not limited thereby. Unless otherwise specified, parts and percentages in the examples are based on mass.

<Manufacturing Example of Resin A-1>

Of the raw material monomers used to polymerize the linear component X, the monomers other than benzoic acid were loaded in the amounts (mol parts) shown in Table 1 into a reaction vessel equipped with a nitrogen introduction pipe, a dewatering pipe, a stirrer and a thermocouple, and dibutyl tin was added as a catalyst in the amount of 1.0 parts per 100 parts of the total raw material monomers.

The temperature inside the vessel was then raised to 150° C. with stirring in a nitrogen atmosphere, after which polymerization was performed by distilling off water while heating at a rate of 10° C./hour from 150° C. to 200° C.

Once 200° C. was reached the inside of the vessel was depressurized to 5 kPa or less, and polycondensation was performed for 3 hours under conditions of 200° C., 5 kPa or less.

The system was then returned to normal pressure, and benzoic acid was added in the amounts shown in Table 1, and reacted for 2 hours with stirring in a nitrogen atmosphere.

The temperature was then lowered to 150° C. with stirring in a nitrogen atmosphere, and of the raw materials used to polymerize the crosslinked component Y, all of the monomers except for part of the trimellitic anhydride (the trimellitic anhydride (late) shown in Table 1) were added in the amounts (mol parts) shown in Table 1.

Polymerization was then performed by distilling off water while heating at a rate of 10° C./hour from 150° C. to 220° C. with stirring in a nitrogen atmosphere, and once 220° C. was reached, the inside of the reaction vessel was depressurized to 5 kPa or less, and polycondensation was performed for 3 hours under conditions of 220° C., 5 kPa or less.

The system was returned to normal pressure, trimellitic anhydride was added in the amounts shown in the trimellitic anhydride (late) column of Table 1, and polycondensation was performed for 3 hours with stirring in a nitrogen atmosphere.

The inside of the reaction vessel was then depressurized to 5 kPa or less, and the mixture was polycondensed for 3 hours with stirring and removed, cooled and pulverized to manufacture a resin A-1. The physical properties of the resulting resin A-1 are shown in Table 1.

TABLE 1

| | | | Resin A-1 | Resin A-2 | Resin A-3 | Resin A-4 | Resin A-5 | Resin A-6 | Resin A-7 | Resin A-8 |
|---|---|---|---|---|---|---|---|---|---|---|
| Linear Component X | BPA-PO | Mol parts | 100.0 | 100.0 | 100.0 | 100.0 | 100.0 | 100.0 | 100.0 | 100.0 |
| | BPA-EO | Mol parts | 0.0 | 0.0 | 0.0 | 0.0 | 0.0 | 0.0 | 0.0 | 0.0 |
| | Terephthalic acid | Mol parts | 70.0 | 70.0 | 70.0 | 70.0 | 80.0 | 80.0 | 65.0 | 55.0 |
| | Isophthalic acid | Mol parts | 0.0 | 0.0 | 0.0 | 0.0 | 0.0 | 0.0 | 0.0 | 5.0 |
| | Adipic acid | Mol parts | 20.0 | 20.0 | 20.0 | 20.0 | 10.0 | 10.0 | 25.0 | 30.0 |
| | Benzoic acid | Mol parts | 20.0 | 20.0 | 20.0 | 20.0 | 15.0 | 10.0 | 25.0 | 25.0 |

TABLE 1-continued

| | | | Resin A-1 | Resin A-2 | Resin A-3 | Resin A-4 | Resin A-5 | Resin A-6 | Resin A-7 | Resin A-8 |
|---|---|---|---|---|---|---|---|---|---|---|
| Crosslinked component Y | BPA-PO | Mol parts | 69.3 | 44.5 | 29.3 | 18.3 | 29.3 | 29.3 | 29.3 | 29.3 |
| | BPA-EO | Mol parts | 0.0 | 0.0 | 0.0 | 0.0 | 0.0 | 0.0 | 0.0 | 0.0 |
| | Terephthalic acid | Mol parts | 20.8 | 13.4 | 8.8 | 5.5 | 8.8 | 15.2 | 7.3 | 4.4 |
| | Isophthalic acid | Mol parts | 0.0 | 0.0 | 0.0 | 0.0 | 5.9 | 0.0 | 0.0 | 2.9 |
| | Adipic acid | Mol parts | 20.8 | 13.4 | 8.8 | 5.5 | 4.4 | 4.4 | 11.7 | 11.7 |
| | Trimellitic anhydride (initial) | Mol parts | 6.9 | 4.5 | 2.9 | 1.8 | 2.9 | 2.9 | 2.9 | 2.9 |
| | Trimellitic anhydride (late) | Mol parts | 13.9 | 8.9 | 5.9 | 3.7 | 4.4 | 4.4 | 4.4 | 4.4 |
| Ratios | Total addition ratio of crosslinking agent | Mol % | 18.8 | 18.8 | 18.8 | 18.8 | 15.1 | 14.9 | 15.1 | 15.1 |
| | Initial addition ratio of crosslinking agent | Mol % | 6.2 | 6.3 | 6.2 | 6.1 | 6.0 | 5.9 | 6.0 | 6.0 |
| | Late addition ratio of crosslinking agent | Mol % | 12.5 | 12.5 | 12.6 | 12.6 | 9.1 | 9.0 | 9.1 | 9.1 |
| | Ratio of linear component | Mol % | 61.5 | 71.3 | 79.0 | 85.8 | 78.6 | 78.1 | 79.5 | 79.5 |
| | Ratio of crosslinked component | Mol % | 38.5 | 28.7 | 21.0 | 14.2 | 21.4 | 21.9 | 20.5 | 20.5 |
| Physical properties | Softening point | ° C. | 188 | 151 | 125 | 109 | 140 | 160 | 118 | 114 |
| | Glass transition temperature | ° C. | 63 | 62 | 62 | 61 | 70 | 74 | 52 | 51 |
| | Acid value | mgKOH/g | 24 | 23 | 22 | 22 | 18 | 19 | 18 | 19 |
| | Hydroxyl value | mgKOH/g | 0 | 0 | 0 | 0 | 3 | 5 | 0 | 0 |

In Tables 1 and 2,

BPA-PO represents bisphenol A propylene oxide adduct (2.0 mol adduct),

BPA-EO represents bisphenol A ethylene oxide adduct (2.0 mol adduct), trimellitic anhydride (initial) represents the amount of trimellitic anhydride added at the same time as the monomers of the crosslinked component Y, trimellitic anhydride (late) represents the amount of trimellitic anhydride added during late polymerization of the crosslinked component Y, mol parts represent a ratio given 100 mol parts as the total amount of the alcohol components (BPA-PO, BPA-EO) used in the linear component X, the total addition ratio of the crosslinking agent is the addition ratio of the crosslinking agent given 100 mol% as the total (mol parts) of the monomers other than the crosslinking agent of the crosslinked component Y, the initial addition ratio of the crosslinking agent is the addition ratio of the crosslinking agent added initially given 100 mol% as the total (mol parts) of the monomers other than the crosslinking agent of the crosslinked component Y, and the late addition ratio of the crosslinking agent is the addition ratio of the crosslinking agent added during late polymerization given 100 mol% as the total (mol parts) of the monomers other than the crosslinking agent of the crosslinked component Y.

<Manufacturing Examples of Resins A-2 to A-8>

The resins A-2 to A-8 were manufactured as in the manufacturing example of the resin A-1 except that the compounded amounts (mol parts) of the raw material monomers used in the linear component X and crosslinked component Y were changed as shown in Table 1 in the manufacturing example of the resin A-1. The physical properties of the resins A-2 to A-8 are shown in Table 1.

<Manufacturing Examples of Resins A-9 to A-14>

The resins A-9 to A-14 were manufactured as in the manufacturing example of the resin A-1 except that the compounded amounts (mol parts) of the raw material monomers used in the linear component X and crosslinked component Y were changed as shown in Table 2 in the manufacturing example of the resin A-1. The physical properties of the resins A-9 to A-14 are shown in Table 2.

TABLE 2

| | | | Resin A-9 | Resin A-10 | Resin A-11 | Resin A-12 | Resin A-13 | Resin A-14 |
|---|---|---|---|---|---|---|---|---|
| Linear Component X | BPA-PO | Mol parts | 50.0 | 100.0 | 50.0 | 50.0 | 100.0 | 100.0 |
| | BPA-EO | Mol parts | 50.0 | 0.0 | 50.0 | 50.0 | 0.0 | 0.0 |
| | Terephthalic acid | Mol parts | 65.0 | 65.0 | 65.0 | 65.0 | 85.0 | 55.0 |
| | Isophthalic acid | Mol parts | 0.0 | 0.0 | 0.0 | 0.0 | 0.0 | 5.0 |
| | Adipic acid | Mol parts | 25.0 | 25.0 | 25.0 | 25.0 | 5.0 | 30.0 |

TABLE 2-continued

| | | | Resin A-9 | Resin A-10 | Resin A-11 | Resin A-12 | Resin A-13 | Resin A-14 |
|---|---|---|---|---|---|---|---|---|
| | Benzoic acid | Mol parts | 7.0 | 7.0 | 7.0 | 7.0 | 5.0 | 28.0 |
| Crosslinked component Y | BPA-PO | Mol parts | 44.5 | 44.5 | 22.3 | 22.3 | 29.3 | 22.0 |
| | BPA-EO | Mol parts | 0.0 | 0.0 | 22.3 | 22.3 | 0.0 | 7.3 |
| | Terephthalic acid | Mol parts | 13.4 | 11.1 | 12.5 | 12.5 | 20.5 | 2.9 |
| | Isophthalic acid | Mol parts | 0.0 | 0.0 | 0.0 | 0.0 | 0.0 | 0.0 |
| | Adipic acid | Mol parts | 13.4 | 15.6 | 16.9 | 16.9 | 3.5 | 12.6 |
| | Trimellitic anhydride (initial) | Mol parts | 4.5 | 4.5 | 0.0 | 11.1 | 2.9 | 1.5 |
| | Trimellitic anhydride (late) | Mol parts | 8.9 | 8.9 | 11.1 | 0.0 | 1.5 | 8.8 |
| Ratios | Total addition ratio of crosslinking agent | Mol % | 18.8 | 18.8 | 15.0 | 15.0 | 8.3 | 23.0 |
| | Initial addition ratio of crosslinking agent | Mol % | 6.3 | 6.3 | 0.0 | 15.0 | 5.4 | 3.3 |
| | Late addition ratio of crosslinking agent | Mol % | 12.5 | 12.5 | 15.0 | 0.0 | 2.8 | 19.6 |
| | Ratio of linear component | Mol % | 69.9 | 70.0 | 69.8 | 69.8 | 77.2 | 79.8 |
| | Ratio of crosslinked component | Mol % | 30.1 | 30.0 | 30.2 | 30.2 | 22.8 | 20.2 |
| Physical properties | Softening point | ° C. | 142 | 144 | 140 | 152 | 150 | 138 |
| | Glass transition temperature | ° C. | 61 | 51 | 48 | 48 | 74 | 55 |
| | Acid value | mgKOH/g | 22 | 25 | 19 | 15 | 22 | 31 |
| | Hydroxyl value | mgKOH/g | 9 | 8 | 11 | 12 | 15 | 0 |

<Manufacturing Example of Resin C-1>

Of the raw material monomers shown in Table 3, all of the monomers except for part of the trimellitic anhydride (the trimellitic anhydride (late) shown in Table 3) were added in the compounded amounts (mol parts) shown in Table 3 to a reaction vessel equipped with a nitrogen introduction pipe, a dewatering pipe, a stirrer and a thermocouple.

Dibutyl tin was then added as a catalyst in the amount of 1.0 parts per 100 parts of the total raw material monomers.

The temperature inside the vessel was then raised to 150° C. with stirring in a nitrogen atmosphere, and polymerization was performed by distilling off water while heating at a rate of 10° C./hour from 150° C. to 220° C.

Once 220° C. was reached, the inside of the reaction vessel was depressurized to 5 kPa or less, and polycondensation was performed for 3 hours under conditions of 220° C., 5 kPa or less.

The system was returned to normal pressure, trimellitic anhydride was added in the amount shown in the trimellitic anhydride (late) column of Table 3, and polycondensation was performed for 3 hours with stirring in a nitrogen atmosphere.

The inside of the reaction vessel was then depressurized to 5 kPa or less, and the mixture was polycondensed for 3 hours with stirring and removed, cooled and pulverized to manufacture a resin C-1. The physical properties of the resulting resin C-1 are shown in Table 3.

TABLE 3

| | | Resin C-1 | Resin C-2 | Resin C-3 | Resin C-4 | Resin C-5 |
|---|---|---|---|---|---|---|
| BPA-PO | Mol parts | 100.0 | 100.0 | 100.0 | 100.0 | 100.0 |
| BPA-EO | Mol parts | 0.0 | 0.0 | 0.0 | 0.0 | 0.0 |

TABLE 3-continued

| | | Resin C-1 | Resin C-2 | Resin C-3 | Resin C-4 | Resin C-5 |
|---|---|---|---|---|---|---|
| Terephthalic acid | Mol parts | 30.1 | 70.0 | 90.0 | 70.1 | 90.0 |
| Fumaric acid | Mol parts | 0.0 | 0.0 | 0.0 | 4.9 | 0.0 |
| Adipic acid | Mol parts | 30.1 | 20.0 | 0.0 | 4.9 | 0.0 |
| Benzoic acid | Mol parts | — | 20.0 | 20.0 | — | — |
| Trimellitic anhydride (initial) | Mol parts | 10.1 | — | — | 15.1 | — |
| Trimellitic anhydride (late) | Mol parts | 20.0 | — | — | — | — |
| Softening point | ° C. | 199 | 98 | 115 | 143 | 105 |
| Glass transition temperature | ° C. | 56 | 44 | 65 | 70 | 50 |
| Acid value | mgKOH/g | 35 | 19 | 20 | 23 | 8 |
| Hydroxyl value | mgKOH/g | 0 | 0 | 0 | 19 | 50 |

In Table 3,

BPA-PO represents bisphenol A propylene oxide adduct (2.0 mol adduct),

BPA-EO represents bisphenol A ethylene oxide adduct (2.0 mol adduct), trimellitic anhydride (initial) represents the amount of trimellitic anhydride added initially, trimellitic anhydride (late) represents the amount of trimellitic anhydride added during late polymerization, and mol parts represent a ratio given 100 mol parts as the total amount of the alcohol components (BPA-PO, BPA-EO) in the raw material monomers.

<Manufacturing Example of Resin C-2>

Of the raw material monomers shown in Table 3, all of the monomers except for the benzoic acid were added in the amounts (mol parts) shown in Table 3 to a reaction vessel equipped with a nitrogen introduction pipe, a dewatering pipe, a stirrer and a thermocouple.

Dibutyl tin was then added as a catalyst in the amount of 1.0 parts per 100 parts of the total raw material monomers.

The temperature inside the vessel was then raised to 150° C. with stirring in a nitrogen atmosphere, and polymerization was performed by distilling off water while heating at a rate of 10° C./hour from 150° C. to 200° C.

Once 200° C. was reached, the inside of the reaction vessel was depressurized to 5 kPa or less, and polycondensation was performed for 3 hours under conditions of 200° C., 5 kPa or less.

The system was returned to normal pressure, benzoic acid was added in the amount shown in Table 3, and this was reacted for 2 hours with stirring in a nitrogen atmosphere and removed, cooled, and pulverized to manufacture a resin C-2. The physical properties of the resulting resin C-2 are shown in Table 3.

<Manufacturing Example of Resin C-3>

A resin C-3 was manufactured as in the manufacturing example of the resin C-2 except that the compounded amounts (mol parts) of the raw material monomers were as shown in Table 3. The physical properties of the resin C-3 are shown in Table 3.

<Manufacturing Example of Resin C-4>

The raw material monomers shown in Table 3 were added in the compounded amounts (mol parts) shown in Table 3 to a reactor equipped with a nitrogen introduction pipe, a dewatering pipe, a stirrer and a thermocouple, and dibutyl tin was then added as a catalyst in the amount of 1.0 parts per 100 parts of the total raw material monomers.

The temperature inside the vessel was then raised to 150° C. with stirring in a nitrogen atmosphere, and polymerization was performed by distilling off water while heating at a rate of 10° C./hour from 150° C. to 220° C.

Once 220° C. was reached, the inside of the vessel was depressurized to 5 kPa or less, and the mixture was polycondensed for 5 hours under conditions of 220° C., 5 kPa or less, and then removed, cooled and pulverized to manufacture a resin C-4. The physical properties of the resin C-4 are shown in Table 3.

<Manufacturing Example of Resin C-5>

The raw material monomers shown in Table 3 were added in the compounded amounts (mol parts) shown in Table 3 to a reaction vessel equipped with a nitrogen introduction pipe, a dewatering pipe, a stirrer and a thermocouple, and dibutyl tin was then added as a catalyst in the amount of 1.0 parts per 100 parts of the total raw material monomers.

The temperature inside the vessel was then raised to 150° C. with stirring in a nitrogen atmosphere, and polymerization was performed by distilling off water while heating at a rate of 10° C./hour from 150° C. to 200° C.

Once 200° C. was reached, the inside of the vessel was depressurized to 5 kPa or less, and polycondensation was performed for 3 hours under conditions of 200° C., 5 kPa or less.

This was then removed, cooled and pulverized to obtain a resin C-5. The physical properties of the resulting resin C-5 are shown in Table 3.

<Manufacturing Example of Aliphatic Compound 1>

A saturated aliphatic hydrocarbon with a peak carbon number of 22 was denatured with acrylic acid to obtain a reaction product. 20 parts of the denatured product were added to 100 parts of n-hexane, and the unchanged component was dissolved and removed to obtain an aliphatic compound 1. The physical properties of the resulting aliphatic compound 1 are shown in Table 4.

TABLE 4

| Aliphatic compound | Type | Peak carbon number |
|---|---|---|
| Aliphatic compound 1 | Denatured saturated monocarboxylic acid | 25 |
| Aliphatic compound 2 | Denatured saturated monoalcohol | 75 |
| Aliphatic compound 3 | Denatured saturated monoalcohol | 100 |

<Manufacturing Example of Aliphatic Compound 2>

1,200 parts of a saturated aliphatic hydrocarbon with a peak carbon number of 75 were placed in a cylindrical glass reactor, and 38.5 parts of boric acid were added at 140° C. A mixed gas of 50 vol % air and 50 vol % nitrogen with an oxygen concentration of about 10 vol % was then immediately blown in at a rate of 20 L per minute, and the mixture was reacted for 3.0 hours at 200° C. After the reaction, warm water was added to the reaction solution, which was then hydrolyzed for 2 hours at 95° C. and left standing, after which the upper layer was taken as the reaction product. 20 parts of the denatured product were added to 100 parts of n-hexane, and the unchanged component was dissolved and removed to obtain an aliphatic compound 2. The physical properties of the resulting aliphatic compound 2 are shown in Table 4.

<Manufacturing Example of Aliphatic Compound 3>

The aliphatic compound 3 was obtained as in the manufacturing example of the aliphatic compound 2 except that the peak carbon number of the saturated aliphatic hydrocarbon was changed. The physical properties of the resulting aliphatic compound 3 are shown in Table 4.

<Manufacturing Example of Resin B-1>

The raw material monomers shown in Table 5 in the amounts (mol parts) shown in Table 5 were loaded into a reaction vessel equipped with a nitrogen introduction pipe, a dewatering pipe, a stirrer and a thermocouple, and dibutyl tin was added as a catalyst in the amount of 1.0 parts per 100 parts of the total raw material monomers. Unilin 700 (Toyo Petrolite, peak carbon number 50, molecular weight 717) was used as the aliphatic compound 4 in this case.

The temperature inside the vessel was raised to 150° C. with stirring in a nitrogen atmosphere, after which polymerization was performed by distilling off water while heating at a rate of 10° C./hour from 150° C. to 200° C.

Once 200° C. was reached, the inside of the vessel was depressurized to 5 kPa or less, and polycondensation was performed for 3 hours under conditions of 200° C., 5 kPa or less. This was then removed, cooled and pulverized to obtain the resin B-1. The physical properties of the resulting resin B-1 are shown in Table 5.

TABLE 5

| | | Resin B-1 | Resin B-2 | Resin B-3 | Resin B-4 | Resin B-5 | Resin 6 |
|---|---|---|---|---|---|---|---|
| BPA-PO | Mol parts | 45.0 | 45.0 | 45.0 | 45.0 | 45.0 | 45.0 |
| BPA-EO | Mol parts | 45.0 | 45.0 | 45.0 | 45.0 | 45.0 | 45.0 |
| Ethylene glycol | Mol parts | 10.0 | 10.0 | 10.0 | 10.0 | 10.0 | 10.0 |
| Terephthalic acid | Mol parts | 105.0 | 90.0 | 103.0 | 105.0 | 108.0 | 95.0 |

TABLE 5-continued

| | | Resin B-1 | Resin B-2 | Resin B-3 | Resin B-4 | Resin B-5 | Resin 6 |
|---|---|---|---|---|---|---|---|
| Aliphatic compound 1 | Mol parts | — | 8.0 | — | — | — | — |
| Aliphatic compound 2 | Mol parts | — | — | 4.0 | — | — | — |
| Aliphatic compound 3 | Mol parts | — | — | — | 3.0 | — | — |
| Aliphatic compound 4 | Mol parts | 5.0 | — | — | — | — | — |
| Aliphatic compound 5 | Mol parts | — | — | — | — | 10.0 | — |
| Softening point | ° C. | 91 | 91 | 94 | 90 | 90 | 93 |
| Glass transition temperature | ° C. | 52 | 52 | 53 | 53 | 50 | 52 |

<Manufacturing Examples of Resins B-2 to B-5 and Resin 6>

The resins B-2 to B-5 and resin 6 were obtained as in the manufacturing example of resin B-1 except that the compounded amounts (mol parts) of the raw material monomers were changed as shown in Table 5.

The molecular weight of the aliphatic compound 1 in this case was 383, the molecular weight of the aliphatic compound 2 was 1,067, and the molecular weight of the aliphatic compound 3 was 1,417.

In the manufacturing example of the resin B-5, 1-dodecanol (Wako Pure Chemical (first grade), carbon number 12, molecular weight 185) was used as the aliphatic compound 5. The physical properties of the resins B-2 to B-5 and resin 6 are shown in Table 5.

<Manufacturing Example of Silica Fine Particle 1>

100 parts of fumed silica (BET: 200 $m^2/g$) obtained by a dry method were treated as a base with 15 parts of hexamethyldisilazane, oil treated with 13 parts of dimethyl silicone oil with a viscosity of 50 $mm^2/sec$ at 25° C., and then pulverized and classified by sieving to obtain a silica fine particle 1.

<Manufacturing Example of Toner 1>

| | |
|---|---|
| Binder resin (resin A-1) | 60.0 pts |
| Binder resin (resin B-1) | 40.0 pts |
| Colorant (magnetic particle 1) | 95.0 pts |

(The magnetic particle 1 is a magnetic iron oxide fine particle with a primary particle number-average particle diameter of 0.12 μm, a holding power Hc of 9.3 kA/m, a magnetization as of σs of 80.6 $Am^2/kg$, and a residual magnetization σr of 12.9 $Am^2/kg$, with the magnetic properties being values obtained in a 10 kOe external magnetic field.)

| | |
|---|---|
| Release agent (Fischer-Tropsch wax) (Sasol C105, melting point 105° C.) | 2.0 pts |

-continued

| | |
|---|---|
| Charge control agent (T-77, Hodogaya Chemical Co., Ltd.) | 2.0 pts |

These materials were mixed in an FM mixer (Nippon Coke & Engineering Co., Ltd.), and then melt kneaded with a twin-screw extruder (Toshiba Machine Co., Ltd., TEM-26SS, ϕ26 mm, L/D=48).

In this case, a kneading screw 1 with a kneading ratio (total length of kneading paddle piece relative to total length of the kneading screw) of 35% was used as the kneading screw.

With a feed rate of 20 kg/hour and a rotation of 200 rpm, the die temperature and the heater temperature of the kneader were adjusted so that the temperature of the binder resin extruded from the die was 150° C.

The resulting kneaded material was cooled, crushed with a hammer mill, and then pulverized with a mechanical pulverizing apparatus (Turbo Kogyo Co., Ltd., T-250), and the resulting finely pulverized product was classified with a multi-division classifier using the Coanda effect, and then surface treated with a mechanical surface treatment apparatus (Hosokawa Micron Corporation, Faculty F-400).

The surface treatment conditions were dispersion rotation 5,500 rpm, classifying rotation 7,000 rpm, number of hammers 8, treated mass per batch 200 g, treatment time 60 seconds (these surface treatment conditions are called conditions 1).

A toner particle 1 with a weight-average particle diameter (D4) of 6.8 μm was thus produced.

Using an FM mixer (FM-10, treatment volume 10 L, Nippon Coke & Engineering Co., Ltd.), materials with the following formulation were loaded and externally added under conditions of rotating blade peripheral speed 35 m/sec, mixing time 180 seconds.

| | |
|---|---|
| Toner particle 1 | 100.0 pts |
| Silica fine particle 1 | 1.20 pts |

This was then passed through a 75-μm mesh sieve to obtain a Toner 1.

The physical properties of the resulting Toner 1 are shown in Table 6.

<Manufacturing Examples of Toners 2 to 10>

The Toners 2 to 10 were obtained as in the manufacturing example of Toner 1 except that the toner particle formulation and the kneading screw conditions were changed in the manufacturing example of Toner 1. The physical properties of the Toners 2 to 10 are shown in Table 6. The kneading screw 2 has a kneading ratio (total length of kneading paddle piece relative to total length of the kneading screw) of 20%, while the kneading screw 3 has a kneading ratio of 50%, the kneading screw 4 has a kneading ratio of 15%, and the kneading screw 5 has a kneading ratio of 55%.

TABLE 6

| | Toner No. | | | | |
|---|---|---|---|---|---|
| | 1 | 2 | 3 | 4 | 5 |
| Binder resin 1 | Resin A-1 | Resin A-1 | Resin A-2 | Resin A-3 | Resin A-4 |
| Mass parts | 60 | 25 | 100 | 100 | 100 |
| Binder resin 2 | Resin B-1 | Resin B-2 | — | — | — |
| Mass parts | 40 | 75 | 0 | 0 | 0 |
| Colorant 1 | Magnetic particle 1 | Magnetic particle 1 | Magnetic particle 1 | Magnetic particle 1 | Magnetic particle 1 |

TABLE 6-continued

| | | | | | |
|---|---|---|---|---|---|
| Mass parts | 95 | 95 | 60 | 60 | 40 |
| Colorant 2 | — | — | — | — | — |
| Mass parts | — | — | — | — | — |
| Kneading screw | Kneading screw 1 | Kneading screw 1 | Kneading screw 1 | Kneading screw 2 | Kneading screw 3 |
| Kneading ratio | 35% | 35% | 35% | 20% | 50% |
| Surface treatment conditions | condition 1 | condilion 1 | condition 1 | condition 1 | condition 1 |
| Softening point (° C.) | 140 | 110 | 144 | 114 | 106 |
| Tgt (° C.) | 62 | 62 | 62 | 61 | 60 |
| Tgf (° C.) | 56 | 57 | 55 | 54 | 54 |
| Tgk (° C.) | 47 | 47 | 45 | 44 | 44 |
| Tgt > Tgf determination | ○ | ○ | ○ | ○ | ○ |
| Tgt − Tgf (° C.) | 6 | 5 | 7 | 7 | 6 |
| Tgt > Tgk determination | ○ | ○ | ○ | ○ | ○ |
| Tgt − Tgk (° C.) | 15 | 15 | 17 | 17 | 16 |
| 35 ≤ Tgf ≤ 70 determination | ○ | ○ | ○ | ○ | ○ |
| Tgt > Tgf > Tgk determination | ○ | ○ | ○ | ○ | ○ |
| Mass % of THF-insoluble component | 21.0 | 7.0 | 22.0 | 8.0 | 3.5 |
| Small particle fraction (% of number) | 2.1 | 2.2 | 2.8 | 2.9 | 4.2 |
| * | ○ | ○ | ○ | ○ | ○ |
| Use of resin B | ○ | ○ | X | X | X |

| | Toner No. | | | | |
|---|---|---|---|---|---|
| | 6 | 7 | 8 | 9 | 10 |
| Binder resin 1 | Resin A-1 | Resin A-1 | Resin A-1 | Resin A-1 | Resin A-1 |
| Mass parts | 75 | 60 | 15 | 15 | 15 |
| Binder resin 2 | Resin B-3 | Resin B-1 | Resin B-4 | Resin 6 | Resin 6 |
| Mass parts | 25 | 40 | 85 | 85 | 85 |
| Colorant 1 | Magnetic particle 1 | Magnetic particle 1 | Magnetic particle 1 | Magnelic particle 1 | Magnelic particle 1 |
| Mass parts | 95 | 95 | 95 | 95 | 95 |
| Colorant 2 | — | — | — | — | — |
| Mass parts | — | — | — | — | — |
| Kneading screw | Kneading screw 1 | Kneading screw 4 | Kneading screw 1 | Kneading screw 1 | Kneading screw 5 |
| Kneading ratio | 35% | 15% | 35% | 35% | 55% |
| Surface treatment conditions | condilion 1 | condition 1 | condition 1 | condition 1 | condition 1 |
| Softening point (° C.) | 149 | 149 | 104 | 104 | 101 |
| Tgt (° C.) | 64 | 63 | 62 | 62 | 61 |
| Tgf (° C.) | 57 | 57 | 57 | 57 | 57 |
| Tgk (° C.) | 47 | 47 | 47 | 47 | 47 |
| Tgt > Tgf determination | ○ | ○ | ○ | ○ | ○ |
| Tgt − Tgf (° C.) | 7 | 6 | 5 | 5 | 4 |
| Tgt > Tgk determination | ○ | ○ | ○ | ○ | ○ |
| Tgt − Tgk (° C.) | 17 | 16 | 15 | 15 | 14 |
| 35 ≤ Tgf ≤ 70 determination | ○ | ○ | ○ | ○ | ○ |
| Tgt > Tgf > Tgk determination | ○ | ○ | ○ | ○ | ○ |
| Mass % of THF-insoluble component | 27.0 | 25.0 | 3.2 | 3.1 | 1.4 |
| Small particle fraction (% of number) | 3.5 | 3.3 | 3.8 | 4.1 | 4.2 |
| * | ○ | ○ | ○ | ○ | ○ |
| Use of resin B | ○ | ○ | ○ | X | X |

*: Binding of component derived from trivalent or higher polyvalent carboxylic acid to ends of molecular chains of resin contained in toluene-insoluble matter <Manufacturing Examples of Toners 11 to 14>

The Toners 11 to 14 were obtained as in the manufacturing example of the Toner 4 except that the binder resin used in the toner particle was changed. The physical properties of the Toners 11 to 14 are shown in Table 7.

<Manufacturing Examples of Toners 15 to 18>

The Toners 15 to 18 were obtained as in the manufacturing example of the Toner 3 except that the binder resin used in the toner particle was changed. The physical properties of the Toners 15 to 18 are shown in Table 7.

<Manufacturing Example of Toner 19>

The Toner 19 was obtained as in the manufacturing example of the Toner 18 except that the surface treatment conditions were changed as follows. The physical properties of the Toner 19 are shown in Table 7.

The surface treatment conditions were dispersion rotation 5,500 rpm, classifying rotation 7,000 rpm, number of hammers 4, treated mass per batch 200 g, treatment time 30 seconds (these surface treatment conditions are called conditions 2).

<Manufacturing Example of Toner 20>

The Toner 20 was obtained as in the manufacturing example of the Toner 18 except that no mechanical surface treatment was performed, and the conditions of the multi-division classifier were adjusted to give the resulting toner particle a weight-average particle diameter (D4) of 6.8 μm. The physical properties of the Toner 20 are shown in Table 7.

<Manufacturing Example of Toner 21>

The toner 21 was obtained as in the manufacturing example of the Toner 20 except that the binder resin used in the toner particle was changed, and the magnetic particle 1 and carbon black 1 (BET specific surface area 60 $m^2/g$, DBP oil absorption 45 $cm^3/_100$ g, shown as CB1 in Table 7) were used together in the mass parts shown in Table 7 as the colorant. The physical properties of the Toner 21 are shown in Table 7.

TABLE 7

| | Toner No. | | | | | |
|---|---|---|---|---|---|---|
| | 11 | 12 | 13 | 14 | 15 | 16 |
| Binder resin 1 | Resin A-5 | Resin A-6 | Resin A-7 | Resin A-8 | Resin A-9 | Resin A-10 |
| Mass parts | 100 | 100 | 100 | 100 | 100 | 100 |
| Binder resin 2 | — | — | — | — | — | — |
| Mass parts | 0 | 0 | 0 | 0 | 0 | 0 |
| Colorant 1 | Magnetic particle 1 | Magnetic particle 1 | Magnetic particle 1 | Magnetic particle 1 | Magnetic particle 1 | Magnetic particle 1 |
| Mass parts | 60 | 60 | 60 | 60 | 60 | 60 |
| Colorant 2 | — | — | — | — | — | — |
| Mass parts | — | — | — | — | — | — |
| Kneading screw | Kneading screw 2 | Kneading screw 2 | Kneading screw 2 | Kneading screw 2 | Kneading screw 1 | Kneading screw 1 |
| Kneading ratio | 20% | 20% | 20% | 20% | 35% | 35% |
| Surface treatment conditions | Condition 1 | Condition 1 | Condition 1 | Condition 1 | Condition 1 | Condition 1 |
| Softening point (° C.) | 133 | 150 | 106 | 101 | 133 | 137 |
| Tgt (° C.) | 70 | 73 | 51 | 51 | 60 | 51 |
| Tgf (° C.) | 65 | 70 | 40 | 35 | 58 | 49 |
| Tgk (° C.) | 49 | 49 | 45 | 43 | 45 | 45 |
| Tgt > Tgf determination | ○ | ○ | ○ | ○ | ○ | ○ |
| Tgt − Tgf (° C.) | 5 | 3 | 11 | 16 | 2 | 2 |
| Tgt > Tgk determination | ○ | ○ | ○ | ○ | ○ | ○ |
| Tgt − Tgk (° C.) | 21 | 24 | 6 | 8 | 15 | 6 |
| 35 ≤ Tgf ≤ 70 determination | ○ | ○ | ○ | ○ | ○ | ○ |
| Tgt > Tgf > Tgk determination | ○ | ○ | X | X | ○ | ○ |
| Mass % of THF-insoluble component | 4.1 | 4.7 | 4.5 | 3.8 | 33.0 | 37.0 |
| Small particle fraction (% of number) | 3.0 | 3.2 | 3.8 | 2.8 | 4.2 | 4.1 |
| * | ○ | ○ | ○ | ○ | ○ | ○ |
| Use of resin B | X | X | X | X | X | X |

| | Toner No. | | | | |
|---|---|---|---|---|---|
| | 17 | 18 | 19 | 20 | 21 |
| Binder resin 1 | Resin A-11 | Resin A-12 | Resin A-12 | Resin A-12 | Resin A-1 |
| Mass parts | 100 | 100 | 100 | 100 | 25 |
| Binder resin 2 | — | — | — | — | Resin B-5 |
| Mass parts | 0 | 0 | 0 | 0 | 75 |
| Colorant 1 | Magnetic particle 1 | Magnetic particle 1 | Magnetic particle 1 | Magnetic particle 1 | Magnetic particle 1 |

TABLE 7-continued

| | | | | | |
|---|---|---|---|---|---|
| Mass parts | 60 | 60 | 60 | 60 | 30 |
| Colorant 2 | — | — | — | — | CB1 |
| Mass parts | — | — | — | — | 3 |
| Kneading screw | Kneading screw 1 | Kneading screw 1 | Kneading screw 1 | Kneading screw 1 | Kneading screw 1 |
| Kneading ratio | 35% | 35% | 35% | 35% | 35% |
| Surface treatment conditions | Condition 1 | Condition 1 | Condition 2 | None | None |
| Softening point (° C.) | 131 | 143 | 143 | 143 | 101 |
| Tgt (° C.) | 49 | 48 | 48 | 49 | 60 |
| Tgf (° C.) | 47 | 46 | 46 | 48 | 57 |
| Tgk (° C.) | 44 | 43 | 43 | 44 | 47 |
| Tgt > Tgf determination | ○ | ○ | ○ | ○ | ○ |
| Tgt − Tgf (° C.) | 2 | 2 | 2 | 1 | 3 |
| Tgt > Tgk determination | ○ | ○ | ○ | ○ | ○ |
| Tgt − Tgk (° C.) | 5 | 5 | 5 | 5 | 13 |
| 35 ≤ Tgf ≤ 70 determination | ○ | ○ | ○ | ○ | ○ |
| Tgt > Tgf > Tgk determination | ○ | ○ | ○ | ○ | ○ |
| Mass % of THF-insoluble component | 15.0 | 42.0 | 43.0 | 42.0 | 4.3 |
| Small particle fraction (% of number) | 3.1 | 5.0 | 7.9 | 10.2 | 11.8 |
| * | ○ | X | X | X | ○ |
| Use of resin B | X | X | X | X | ○ |

*: Binding of component derived from trivalent or higher polyvalent carboxylic acid to ends of molecular chains of resin contained in toluene-insoluble matter <Manufacturing Examples of Toners 22 to 24>

The Toners 22 to 24 were obtained as in the manufacturing example of the Toner 3 except that the binder resin used in the toner particle was changed, no mechanical surface treatment was performed, and the conditions of the multi-division classifier were adjusted to give the resulting toner particle a weight-average particle diameter (D4) of 6.8 μm. The physical properties of the Toners 22 to 24 are shown in Table 8.

<Manufacturing Examples of Toners 25 and 26>

The Toners 25 and 26 were obtained as in the manufacturing example of the Toner 4 except that the binder resin used in the toner particle was changed, no mechanical surface treatment was performed, and the conditions of the multi-division classifier were adjusted to give the resulting toner particle a weight-average particle diameter (D4) of 6.8 μm. The physical properties of the Toners 25 and 26 are shown in Table 8.

<Manufacturing Example of Toner 27>

The Toner 27 was obtained as in the manufacturing example of the Toner 1 except that the binder resin used in the toner particle was changed, no mechanical surface treatment was performed, and the conditions of the multi-division classifier were adjusted to give the resulting toner particle a weight-average particle diameter (D4) of 6.8 μm. The physical properties of the Toner 27 are shown in Table 8.

<Manufacturing Example of Toner 28>

The Toner 28 was obtained as in the manufacturing example of the Toner 6 except that the kneading screw conditions were changed, no mechanical surface treatment was performed, and the conditions of the multi-division classifier were adjusted to give the resulting toner particle a weight-average particle diameter (D4) of 6.8 μm. The physical properties of the Toner 28 are shown in Table 8.

<Manufacturing Example of Toner 29>

The Toner 29 was obtained as in the manufacturing example of the Toner 3 except that the kneading screw conditions were changed, no mechanical surface treatment was performed, and the conditions of the multi-division classifier were adjusted to give the resulting toner particle a weight-average particle diameter (D4) of 6.8 μm. The physical properties of the Toner 29 are shown in Table 8.

<Manufacturing Example of Toner 30>

The Toner 30 was obtained as in the manufacturing example of the Toner 5 except that the kneading screw conditions were changed, no mechanical surface treatment was performed, and the conditions of the multi-division classifier were adjusted to give the resulting toner particle a weight-average particle diameter (D4) of 6.8 μm. The physical properties of the Toner 30 are shown in Table 8.

<Manufacturing Example of Toner 31>

The Toner 31 was obtained as in the manufacturing example of the Toner 1 except that the binder resin used in the toner particle was changed, no mechanical surface treatment was performed, and the conditions of the multi-division classifier were adjusted to give the resulting toner particle a weight-average particle diameter (D4) of 6.8 μm. The physical properties of the Toner 31 are shown in Table 8.

TABLE 8

| | Toner No. | | | | | | | | | |
|---|---|---|---|---|---|---|---|---|---|---|
| | 22 | 23 | 24 | 25 | 26 | 27 | 28 | 29 | 30 | 31 |
| Binder resin 1 | Resin C-1 | Resin C-1 | Resin C-4 | Resin A-13 | Resin A-14 | Resin A-1 | Resin A-1 | Resin A-2 | Resin A-4 | Resin A-1 |
| Mass parts | 30 | 30 | 75 | 100 | 100 | 100 | 75 | 100 | 100 | 10 |
| Binder resin 2 | Resin C-2 | Resin C-3 | Resin C-5 | — | — | — | Resin B-3 | — | — | Resin B-4 |
| Mass parts | 70 | 70 | 25 | 0 | 0 | 0 | 25 | 0 | 0 | 90 |
| Colorant 1 | Magnetic particle 1 | Magnetic particle 1 | Magnetic particle 1 | Magnetic particle 1 | Magnetic particle 1 | Magnetic particle 1 | Magnetic particle 1 | Magnetic particle 1 | Magnetic particle 1 | Magnetic particle 1 |
| Mass parts | 60 | 60 | 60 | 60 | 60 | 95 | 95 | 60 | 40 | 95 |
| Colorant 2 | — | — | — | — | — | — | — | — | — | — |
| Mass parts | — | — | — | — | — | — | — | — | — | — |
| Kneading screw | Kneading screw 1 | Kneading screw 1 | Kneading screw 1 | Kneading screw 2 | Kneading screw 2 | Kneading screw 1 | Kneading screw 4 | Kneading screw 4 | Kneading screw 5 | Kneading screw 1 |
| Kneading ratio | 35% | 35% | 35% | 20% | 20% | 35% | 15% | 15% | 55% | 35% |
| Surface treatment conditions | None | None | None | None | None | None | None | None | None | None |
| Softening point (° C.) | 137 | 140 | 137 | 140 | 131 | 177 | 156 | 152 | 98 | 98 |
| Tgt (° C.) | 51 | 62 | 65 | 73 | 51 | 65 | 64 | 62 | 60 | 62 |
| Tgf (° C.) | 55 | 55 | 72 | 72 | 33 | 57 | 57 | 55 | 54 | 57 |
| Tgk (° C.) | 45 | 65 | 47 | 50 | 43 | 47 | 47 | 45 | 44 | 47 |
| Tgt > Tgf determination | X | ○ | X | ○ | ○ | ○ | ○ | ○ | ○ | ○ |
| Tgt − Tgf (° C.) | −4 | 7 | −7 | 1 | 18 | 8 | 7 | 7 | 6 | 5 |
| Tgt > Tgk determination | ○ | X | ○ | ○ | ○ | ○ | ○ | ○ | ○ | ○ |
| Tgt − Tgk (° C.) | 6 | −3 | 18 | 23 | 8 | 18 | 17 | 17 | 16 | 15 |
| 35 ≤ Tgf ≤ 70 determination | ○ | ○ | X | X | X | ○ | ○ | ○ | ○ | ○ |
| Tgt > Tgf > Tgk determination | X | X | X | ○ | X | ○ | ○ | ○ | ○ | ○ |
| Mass % of THF-insoluble component | 22.0 | 22.0 | 17.0 | 23.0 | 14.0 | 33.0 | 24.8 | 25.0 | 1.1 | 2.1 |
| Small particle fraction (% of number) | 13.0 | 13.2 | 11.9 | 13.0 | 14.5 | 12.3 | 11.8 | 14.3 | 12.5 | 13.1 |
| * | X | X | X | ○ | ○ | ○ | ○ | ○ | ○ | ○ |
| Use of resin B | X | X | X | X | X | X | ○ | X | X | ○ |

*: Binding of component derived from trivalent or higher polyvalent carboxylic acid to ends of molecular chains of resin contained in toluene-insoluble matter

Example 1

The Toner 1 was evaluated as follows. The evaluation results are shown in Table 9. Unless otherwise specified, PB Paper (Canon Marketing Japan Inc., weight 66 g/cm$^2$, letter) was used as the evaluation paper.

An HP LaserJet Enterprise M606dn modified to obtain a process speed of 400 mm/sec was used as the evaluation unit.

<Discharge Adhesion>

Using the modified unit, all the cooling fans inside main body were turned off, and discharge adhesion was evaluated in double-sided continuous printing mode in a high-temperature, high humidity environment (strict conditions for discharge adhesion).

A cartridge was emptied of toner, and then filled with 700 g of the Toner 1 for the evaluation. PB Paper (Canon Marketing Japan Inc., weight 66 g/cm$^2$, letter) was used as the evaluation paper.

The evaluation was performed in a high-temperature, high-humidity environment (32.5° C., 85% RH) in double-sided printing mode, by continuously printing 100 sheets (200 pages) with an overall solid image on the front side and a text image (E letter, print percentage 5%) on the reverse side, and stacking the images in the paper discharge tray.

After completion of printing, these were left for 10 minutes, the images on the 100 sheets were peeled apart sheet by sheet and visually evaluated, and the number of sheets with images having white defects caused by missing toner due to adhesion between the solid image (front) and text image (back) (number of defective sheets) was counted and evaluated according to the following standards. A grade of A to C means that the effects of the invention of the present application have been obtained.

A: No defective sheets

B: At least 1 and not more than 5 defective sheets

C: At least 6 and not more than 10 defective sheets

D: 11 or more defective sheets

<Friction Density Decrease>

Friction density decrease was evaluated using an external fixing unit obtained by taking out the fixing unit from the aforementioned evaluation unit, and modifying it so that the temperature of the fixing unit could be set arbitrarily and so that the process speed was 400 mm/sec.

Using this unit in a low-temperature, low-humidity environment (15° C., 10% RH), an unfixed image set to a toner laid-on level of 0.5 mg/cm$^2$ per unit area was passed through the fixing unit, which had been adjusted to a temperature of 150° C. Plover Bond Paper (105 g/m$^2$, Fox River Paper Company, LLC) was used as the recording medium. The resulting fixed image was rubbed with Silbon paper under a load of 4.9 kPa (50 g/cm$^2$), and the image density decrease after rubbing (%) was evaluated. A grade of A to C means that the effects of the invention of the present application were obtained.

A: Image density decrease rate less than 10.0%

B: Image density decrease rate at least 10.0% and less than 15.0%

C: Image density decrease rate at least 15.0% and less than 20.0%

D: Image density decrease rate at least 20.0%

<Fixing Spot Defects>

Spot defects were evaluated using an external fixing unit obtained by taking out the fixing unit from the evaluation unit, and modifying it so that the temperature of the fixing unit could be set arbitrarily and so that the process speed was 400 mm/sec.

Using this unit in a low-temperature, low-humidity environment (15° C., 10% RH), an unfixed overall solid image set to a toner laid-on level of 1.0 mg/cm$^2$ per unit area was passed through the fixing unit, which had been adjusted to a temperature of 150° C. PB Paper (Canon Marketing Japan Inc., weight 66 g/cm$^2$, letter) was used as the recording medium.

The resulting image was visually checked, the number of spots where toner was missing due to insufficient toner fixing were counted, and used to evaluate spot defects according to the following standard. A grade of A to C means that the effects of the invention of the present application have been obtained.

A: Fewer than 4 spot defects

B: At least 4 and fewer than 8 spot defects

C: At least 8 and fewer than 11 spot defects

D: 11 or more spot defects

<Curling Resistance>

Curling resistance was evaluated using the modified unit. A cartridge was emptied of toner, and then filled with 700 g of the Toner 1 for the evaluation.

The evaluation was performed in a high-temperature, high-humidity environment (32.5° C., 85% RH), which is a strict environment for curling, using PB Paper (Canon Marketing Japan Inc., weight 66 g/cm$^2$, letter) as the evaluation paper.

100 prints of an overall solid image were output continuously in single-sided continuous printing mode, with a 5 mm blank leading edge, a 5 mm blank trailing edge and 5 mm blank left and right margins.

The 100 prints were stacked after image output in the same environment with the solid image sides facing up, and a 100 g weight 210 mm×30 mm in size was laid on the trailing edge of the paper, with the 210 mm side of the weight aligned with the trailing edge of the paper.

The height of the trailing edge of the paper stack and the height of the leading edge of the paper stack were then measured, the height of the trailing edge was subtracted from the height of the leading edge, and the result was divided by the height of the trailing edge and multiplied by 100 to obtain a height ratio (%).

A greater height ratio indicates more curling, which was evaluated according to the following standard. A grade of A to C means that the effects of the invention of the present application have been obtained.

A: Height ratio less than 6%

B: Height ratio at least 6% and less than 11%

C: Height ratio at least 11% and less than 16%

D: Height ratio at least 16%

<Severe Storability>

A cartridge was emptied of toner, and then filled with 700 g of the Toner 1. This was first tapped 300 times with the drive side facing downward to densely pack the toner.

The cartridge was then left for 90 days in a severe environment (40° C., 95% RH) with the drive side facing downward to evaluate severe storability in a harsh environment.

The cartridge was removed, and an image output test was performed using the modified unit in a high-temperature, high-humidity environment (32.5° C., 85% RH) to evaluate severe storability.

For the image output test, first 1,000 sheets of a horizontal line pattern with a print percentage of 2.0% were output two sheets per job with the mode set so that the machine was stopped temporarily between jobs, and then a check image was output in the same environment.

A 200 mm×280 mm halftone image (dot print percentage 23%) was output as the check image, which was then observed visually for vertical streaks, and evaluated according to the following standard. A grade of A to C means that the effects of the invention of the present application have been obtained.

A: No streaks

B: At least 1 and not more than 5 streaks less than 1 mm in width, no streaks 1 mm or more in width C: 6 or more streaks less than 1 mm in width, no streaks 1 mm or more in width D: Some streaks 1 mm or more in width <Image Density after Endurance>

This was evaluated using the modified unit. A cartridge was emptied of toner, and filled with 700 g of the Toner 1.

For the image output test, 25,000 sheets of a horizontal line pattern with a print percentage of 1.5% were output two sheets per job, with the mode set so that the machine was stopped temporarily between jobs. The evaluation was performed in a high-temperature, high-humidity environment (32.5° C., 85% RH), which is a strict environment for toner deterioration. PB Paper (Canon Marketing Japan Inc., weight 66 g/cm$^2$, letter) was used as the evaluation paper.

On the 25,001st sheet, a check image was output having a 5 mm blank leading edge, 5 mm blank left and right margins, and a total of nine 5 mm×5 mm solid black patch images, spaced 30 mm apart with three images extending across of the paper on the left, center and right and three images extending lengthwise.

The image densities of the nine solid black patch images of this check image were measured, and the average calculated. Image density was measured using a Macbeth reflection densitometer (GretagMacbeth GmbH) and an SPI filter, and evaluated according to the following standard. A grade of A to C means that the effects of the invention of the present application have been obtained.

A: Image density at least 1.40

B: Image density at least 1.30 but less than 1.40

C: Image density at least 1.20 but less than 1.30

D: Image density less than 1.20

<Line Width after Endurance>

This was evaluated using the modified unit. A cartridge was emptied of toner, and filled with 700 g of the Toner 1.

For the output test, 25,000 sheets of a horizontal line pattern with a print percentage of 1.5% were output two sheets per job, with the mode set so that the machine was stopped temporarily between jobs.

The evaluation was performed in a high-temperature, high-humidity environment (32.5° C., 85% RH), which is a strict environment for toner deterioration.

PB Paper (Canon Marketing Japan Inc., weight 66 g/cm$^2$, letter) was used as the evaluation paper.

On the 25,001st sheet, 4-dot (170 μm as 600 dpi latent image) 10 mm-long vertical lines and 4-dot (170 μm as 600 dpi latent image) 10 mm-long horizontal lines were output in a total of nine locations, with three images thereof being spaced 10 mm apart across the paper on the left, center and right and three images thereof being spaced 30 mm apart in the lengthwise direction, and with a 5 mm blank leading edge and 5 mm blank left and right margins.

The resulting image was observed with a VK-8500 microscope (Keyence Corporation), the thicknesses of the 9 vertical lines and the 9 horizontal lines were measured, and the vertical line thicknesses and horizontal line thicknesses were averaged to determine the line width after endurance.

The thickness of each line was measured at 5 points and averaged, and the average of the total of 18 vertical and horizontal lines was used to evaluate line width after endurance by the following standard. A grade of A to C means that the effects of the invention of the present application have been obtained.

A: Line width at least 160 μm

B: Line width at least 150 μm and less than 160 μm

C: Line width at least 140 μm and less than 150 μm

D: Line width less than 140 μm

<Pressurized Storability of Image>

This was evaluated using the modified unit. A cartridge was emptied of toner, and then filled with 700 g of the Toner 1. PB Paper (Canon Marketing Japan Inc., weight 66 g/cm$^2$, letter) was used as the evaluation paper.

With a normal temperature, normal humidity environment (23° C., 50% RH) as the image output environment, 10 sheets (20 pages) were output continuously in double-sided printing mode with an overall solid image on the front side and a text image (E letter, print percentage 5%) on the reverse side. This operation was performed 10 times to obtain 100 sheets (200 pages) of double-sided printed images.

The 100 sheets of double-sided printed images were transferred while still stacked to a high-temperature, high-humidity environment (32.5° C., 85% RH), and 100 sheets of PB paper were laid as a weight over the 100 stacked sheets of double-sided printed images, and left for 30 days in the same condition.

After 30 days, the 100 sheets of double-sided printed images were transferred to a normal temperature, normal humidity environment (23° C., 50% RH), and after 1 day of humidity adjustment, the images on the 100 sheets were peeled apart one at a time and visually verified. The number of sheets with images having white defects caused by missing toner due to adhesion between the solid image (front) and text image (back) (number of defective sheets) was counted and evaluated according to the following standard. A grade of A to C means that the effects of the invention of the present application have been obtained.

A: No defective sheets

B: At least 1 and not more than 5 defective sheets

C: At least 6 and not more than 10 defective sheets

D: 11 or more defective sheets

<Line Width Uniformity>

This was evaluated using the modified unit. A cartridge was emptied of toner, and filled with 700 g of the Toner 1. For the image output test, 1,000 sheet of a horizontal line pattern with a print percentage of 1.5% were output 2 sheets per job, with the mode set so that the machine was stopped temporarily between jobs.

PB Paper (Canon Marketing Japan, weight 66 g/cm$^2$, letter) was used as the evaluation paper.

The evaluation was performed in a high-temperature, high-humidity environment (32.5° C., 85% RH), which is a strict environment for uniform line width development because the adhesive force between toner is likely to be strong.

On the 1,001st sheet, 4-dot (170 μm as 600 dpi latent image) 10 mm-long vertical lines and 4-dot (170 μm as 600 dpi latent image) 10 mm-long horizontal lines were output in a total of nine locations with three images spaced 10 mm apart across the paper on the left, center and right and three images spaced 30 mm apart in the lengthwise direction, and with a 5 mm blank leading edge and 5 mm blank left and right margins.

The resulting image was observed with a VK-8500 microscope (Keyence Corporation), the thickness of each vertical line was measured at five points and averaged, and the average value of the thickness of the nine vertical lines was determined.

Similarly, the thickness of each horizontal line was measured at five points and averaged, and the average value of the thickness of nine horizontal lines was determined.

The average thickness of the vertical lines was subtracted from the average thickness of the horizontal lines, divided by the average thickness of the horizontal lines, and multiplied by 100 to determine the vertical-horizontal difference (%), and the line width uniformity was evaluated according to the following standard. A grade of A to C means that the effects of the invention of the present application have been obtained.

A: Vertical-horizontal difference less than 6%

B: Vertical-horizontal difference at least 6% and less than 11%

C: Vertical-horizontal difference at least 11% and less than 16%

D: Vertical-horizontal difference at least 16%

<Dot Reproducibility>

An evaluation was performed using the modified unit. A cartridge was emptied of toner, and filled with 700 g of the Toner 1.

For the output test, 1,000 sheets of a horizontal line pattern with a print percentage of 1.5% were output two sheets per job, with the mode set so that the machine was stopped temporarily between jobs.

On the 1,001st sheet, a check image was output having a 1 mm×1 mm solid black patch pattern. The resulting image was observed with a VK-8500 microscope (Keyence Corp.), and the number of scattered toner spots in a 3 mm×3 mm region around the 1 mm×1 mm solid black patch was counted.

A: No scattered toner spots

B: At least 1 and not more than 10 scattered toner spots

C: At least 11 and not more than 20 scattered toner spots

D: 21 or more scattered toner spots

<Examples 2 to 21, Comparative Examples 1 to 10>

Evaluations were performed as in Example 1 except that the Toner 1 was changed to the toners described in Tables 9 to 11. The results are shown in Tables 9 to 11.

TABLE 9

| | Example No. | | | | | | | | | |
|---|---|---|---|---|---|---|---|---|---|---|
| | 1 | 2 | 3 | 4 | 5 | 6 | 7 | 8 | 9 | 10 |
| Toner No. | 1 | 2 | 3 | 4 | 5 | 6 | 7 | 8 | 9 | 10 |
| Discharge adhesion | A | A | A | A | A | A | A | A | A | A |
| Number of defective sheets | 0 | 0 | 0 | 0 | 0 | 0 | 0 | 0 | 0 | 0 |
| Friction density decrease | A | A | A | A | A | B | B | A | A | A |
| Density decrease rate | 5 | 3 | 6 | 3 | 3 | 13 | 12 | 4 | 4 | 3 |
| Fixing spot defects | A | A | A | A | A | A | A | A | A | A |
| Number of spot defects | 0 | 0 | 2 | 2 | 2 | 0 | 0 | 0 | 2 | 3 |
| Curling | A | A | A | A | A | A | A | B | B | B |
| Height ratio | 2 | 3 | 3 | 3 | 4 | 3 | 3 | 6 | 7 | 7 |
| Severe storability | A | A | A | A | A | A | A | A | A | A |
| Number of streaks of less than 1 mm | 0 | 0 | 0 | 0 | 0 | 0 | 0 | 0 | 0 | 0 |
| Number of streaks of 1 mm or more | 0 | 0 | 0 | 0 | 0 | 0 | 0 | 0 | 0 | 0 |
| Durability 1 | A | A | A | A | A | A | A | B | B | B |
| Density after endurance | 1.49 | 1.47 | 1.49 | 1.47 | 1.47 | 1.44 | 1.44 | 1.38 | 1.38 | 1.36 |
| Durability 2 | A | A | A | A | B | A | A | B | B | C |
| Line width after endurance | 168 | 168 | 166 | 168 | 158 | 163 | 163 | 158 | 156 | 149 |
| Storability of image under pressure | A | A | B | B | B | A | A | A | B | B |
| Number of defective sheets | 0 | 0 | 1 | 2 | 2 | 0 | 0 | 0 | 3 | 3 |
| Line width uniformity | A | A | A | A | A | A | A | A | A | A |
| Vertical-horizontal difference (%) | 3 | 4 | 3 | 4 | 5 | 4 | 4 | 3 | 4 | 3 |
| Dot reproducibility | A | A | A | B | B | A | C | A | A | C |
| Scattered toner spots | 0 | 0 | 0 | 6 | 7 | 0 | 11 | 0 | 0 | 13 |

TABLE 10

| | Example No. | | | | | | | | | | |
|---|---|---|---|---|---|---|---|---|---|---|---|
| | 11 | 12 | 13 | 14 | 15 | 16 | 17 | 18 | 19 | 20 | 21 |
| Toner No. | 11 | 12 | 13 | 14 | 15 | 16 | 17 | 18 | 19 | 20 | 21 |
| Discharge adhesion | A | A | A | A | B | B | C | C | C | C | C |
| Number of defective sheets | 0 | 0 | 0 | 0 | 3 | 4 | 6 | 7 | 7 | 8 | 10 |
| Friction density decrease | A | C | A | A | A | A | A | A | A | A | A |
| Density decrease rate | 7 | 17 | 4 | 5 | 5 | 4 | 4 | 4 | 4 | 4 | 9 |
| Fixing spot defects | B | C | A | A | B | B | A | C | C | C | A |
| Number of spot defects | 5 | 9 | 3 | 3 | 6 | 6 | 3 | 8 | 8 | 8 | 3 |
| Curling | A | A | A | B | A | A | A | A | A | A | C |
| Height ratio | 3 | 3 | 5 | 9 | 3 | 4 | 3 | 3 | 3 | 3 | 13 |
| Severe storability | A | A | B | C | A | A | A | A | A | A | B |
| Number of streaks of less than 1 mm | 0 | 0 | 3 | 9 | 0 | 0 | 0 | 0 | 0 | 0 | 5 |
| Number of streaks of 1 mm or more | 0 | 0 | 0 | 0 | 0 | 0 | 0 | 0 | 0 | 0 | 0 |
| Durability 1 | A | A | C | C | A | A | A | A | A | A | B |
| Density after endurance | 1.41 | 1.40 | 1.29 | 1.24 | 1.43 | 1.41 | 1.41 | 1.40 | 1.40 | 1.40 | 1.33 |
| Durability 2 | B | B | B | B | A | A | A | A | A | A | B |
| Line width after endurance | 156 | 154 | 154 | 152 | 161 | 161 | 161 | 160 | 160 | 160 | 154 |
| Storability of image under pressure | B | B | B | B | B | B | B | C | C | C | B |
| Number of defective sheets | 3 | 3 | 3 | 3 | 4 | 4 | 5 | 8 | 8 | 8 | 5 |
| Line width uniformity | A | A | A | A | A | A | A | A | B | C | C |
| Vertical-horizontal difference (%) | 4 | 4 | 3 | 5 | 5 | 5 | 5 | 5 | 9 | 13 | 15 |
| Dot reproducibility | A | A | A | A | A | A | A | A | A | B | B |
| Scattered toner spots | 0 | 0 | 0 | 0 | 0 | 0 | 0 | 0 | 0 | 8 | 8 |

TABLE 11

| | Comparative Example No. | | | | | | | | | |
|---|---|---|---|---|---|---|---|---|---|---|
| | 1 | 2 | 3 | 4 | 5 | 6 | 7 | 8 | 9 | 10 |
| Toner No. | 22 | 23 | 24 | 25 | 26 | 27 | 28 | 29 | 30 | 31 |
| Discharge adhesion | D | D | D | C | B | B | B | B | B | B |
| Number of defective sheets | 23 | 16 | 22 | 9 | 4 | 4 | 4 | 5 | 5 | 5 |
| Fricton density decrease | B | B | B | C | B | D | D | D | B | B |
| Density decrease rate | 14 | 14 | 14 | 19 | 13 | 31 | 25 | 26 | 12 | 12 |

TABLE 11-continued

| | Comparative Example No. | | | | | | | | | |
|---|---|---|---|---|---|---|---|---|---|---|
| | 1 | 2 | 3 | 4 | 5 | 6 | 7 | 8 | 9 | 10 |
| Fixing spot defects | B | C | D | D | B | B | B | B | B | B |
| Number of spot defects | 6 | 10 | 14 | 15 | 5 | 6 | 6 | 6 | 4 | 4 |
| Curling | B | B | B | B | B | B | B | B | D | D |
| Height ratio | 10 | 9 | 9 | 9 | 10 | 9 | 9 | 9 | 23 | 22 |
| Severe storability | C | B | C | B | D | B | B | B | B | B |
| Number of streaks of less than 1 mm | 11 | 5 | 13 | 5 | 10 | 4 | 4 | 4 | 4 | 5 |
| Number of streaks of 1 mm or more | 0 | 0 | 0 | 0 | 5 | 0 | 0 | 0 | 0 | 0 |
| Durability 1 | B | B | B | B | D | B | B | B | C | C |
| Density after endurance | 1.32 | 1.32 | 1.33 | 1.32 | 1.12 | 1.33 | 1.32 | 1.32 | 1.21 | 1.20 |
| Durability 2 | B | B | B | B | C | B | B | B | D | D |
| Line width after endurance | 150 | 152 | 150 | 150 | 140 | 152 | 152 | 150 | 126 | 127 |
| Storability of image under pressure | D | D | D | C | C | C | B | C | C | B |
| Number of defective sheets | 15 | 12 | 13 | 9 | 10 | 9 | 5 | 9 | 10 | 5 |
| Line width uniformity | D | D | D | C | C | C | C | C | C | C |
| Vertical-horizontal difference (%) | 20 | 18 | 19 | 15 | 14 | 15 | 15 | 14 | 15 | 15 |
| Dot reproducibility | B | B | B | B | B | B | D | D | D | B |
| Scattered toner spots | 10 | 10 | 9 | 10 | 10 | 10 | 22 | 23 | 21 | 10 |

The present invention provides a toner with good low-temperature fixability, severe storability and curl resistance, as well as good discharge adhesion properties.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-247445, filed, Dec. 21, 2016, Japanese Patent Application No. 2017-214464, filed, Nov. 7, 2017, which are hereby incorporated by reference herein in their entirety.

What is claimed is:

1. A toner comprising a toner particle including a binder resin and a colorant, wherein the toner has a softening point of 100 to 150° C., the toner satisfies Tgt>Tgf where Tgt represents a glass transition temperature (° C.) of the toner during a second temperature rise as measured with a differential scanning calorimeter (DSC), and Tgf is 35-70° C. and represents a glass transition temperature (° C.) of a tetrahydrofuran-insoluble matter of the binder resin during a second temperature rise as measured with a differential scanning calorimeter (DSC), the tetrahydrofuran-insoluble matter of the binder resin being the tetrahydrofuran-insoluble matter of the binder resin after the toner has been extracted for 18 hours by Soxhlet extraction using tetrahydrofuran, and the toner satisfies Tgt>Tgk where Tgk represents a glass transition temperature (° C.) of a tetrahydrofuran-soluble matter of the binder resin during a second temperature rise as measured with a differential scanning calorimeter (DSC), the tetrahydrofuran-soluble matter of the binder resin being the tetrahydrofuran-soluble matter of the binder resin after the toner has been extracted for 18 hours by Soxhlet extraction using tetrahydrofuran.

2. The toner according to claim 1, wherein

Tgt>Tgf>Tgk.

3. The toner according to claim 1, wherein the content of the tetrahydrofuran-insoluble matter in the binder resin is 3.0 to 50.0 mass % of the binder resin.

4. The toner according to claim 1, wherein a component derived from a trivalent or higher polyvalent carboxylic acid is bound to the end of molecular chains of a resin contained in the toluene-insoluble matter of the binder resin after the toner has been extracted for 2 hours by Soxhlet extraction using toluene.

5. The toner according to claim 1, wherein the toner has a small particle fraction with a circle-equivalent diameter of less than 1.985 μm, of not more than 8.0 numerical %.

6. The toner according to claim 1, wherein the binder resin contains a polyester resin A that includes linear and crosslinked components.

7. The toner according to claim 1, wherein the binder resin contains polyester resin B that has a partial structure represented by $R_1$—O— or $R_2$—COO—, where $R_1$ represents a group having a structure in which a hydrogen atom is removed of a $C_{12-102}$ aliphatic hydrocarbon, and $R_2$ represents a group having a structure in which a hydrogen atom is removed of a $C_{11-101}$ aliphatic hydrocarbon.

8. The toner according to claim 1, wherein the binder resin contains polyester resins A and B, wherein resin A includes linear and crosslinked components, and resin B has a partial structure represented by $R_1$—O— or $R_2$—COO—, where $R_1$ represents a group having a structure in which a hydrogen atom is removed of a $C_{12-102}$ aliphatic hydrocarbon, and $R_2$ represents a group having a structure in which a hydrogen atom is removed of a $C_{11-101}$ aliphatic hydrocarbon.

* * * * *